US008662495B2

(12) United States Patent
Kitazawa et al.

(10) Patent No.: US 8,662,495 B2
(45) Date of Patent: Mar. 4, 2014

(54) MEDIUM FEEDING DEVICE AND IMAGE FORMING APPARATUS

(75) Inventors: Yoshiyuki Kitazawa, Kanagawa (JP); Hajime Yoshii, Kanagawa (JP); Hiroaki Fujikura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/442,218

(22) Filed: Apr. 9, 2012

(65) Prior Publication Data

US 2013/0020755 A1 Jan. 24, 2013

(30) Foreign Application Priority Data

Jul. 22, 2011 (JP) ..... 2011-160803

(51) Int. Cl.
*B65H 3/12* (2006.01)

(52) U.S. Cl.
USPC ..... 271/96; 271/90; 271/94; 271/98; 271/108

(58) Field of Classification Search
USPC ..... 271/90, 94, 96, 98, 108
See application file for complete search history.

(56) References Cited

U.S. PATENT DOCUMENTS

| | | | | |
|---|---|---|---|---|
| 4,185,814 | A * | 1/1980 | Buchmann et al. | 271/108 |
| 4,513,957 | A * | 4/1985 | Schaefer, Jr. | 271/90 |
| 4,651,984 | A * | 3/1987 | Emrich | 271/237 |
| 4,768,769 | A * | 9/1988 | Roller | 271/11 |
| 5,988,626 | A * | 11/1999 | La Vos et al. | 271/96 |
| 6,398,206 | B1 * | 6/2002 | Yang et al. | 271/90 |
| 7,328,895 | B2 * | 2/2008 | Dinatale et al. | 271/11 |
| 2007/0063419 | A1 * | 3/2007 | Moore et al. | 271/90 |
| 2007/0170638 | A1 * | 7/2007 | Ikeda | 271/98 |
| 2007/0228640 | A1 * | 10/2007 | Ikeda | 271/98 |
| 2010/0207315 | A1 * | 8/2010 | Todoriki et al. | 271/94 |

FOREIGN PATENT DOCUMENTS

| | | | |
|---|---|---|---|
| JP | 07-089625 | A | 4/1995 |
| JP | 2002-019978 | A | 1/2002 |
| JP | 2005-194027 | A | 7/2005 |
| JP | 2007-106567 | A | 4/2007 |
| JP | 2008-094603 | A | 4/2008 |
| JP | 2010-024057 | A | 2/2010 |
| JP | 2010-143658 | A | 7/2010 |
| JP | 2010-149982 | A | 7/2010 |

* cited by examiner

*Primary Examiner* — Prasad Gokhale
(74) *Attorney, Agent, or Firm* — Sughrue Mion, PLLC

(57) ABSTRACT

A medium feeding device includes a medium-accommodating container, a loading member supported within the container and loading a medium thereon, a holding member, and a blocking unit. The holding member has a holding member body, gas suction openings, a peripheral member, a chamber surrounded by the peripheral member, and a suction unit connected to the gas suction openings and performing gas suction. The holding member holds the medium by suction. The gas suction openings include a gas suction opening disposed inside an edge of the peripheral member and outside an edge of the medium. The blocking unit blocks the suction of gas through the aforementioned gas suction opening.

22 Claims, 23 Drawing Sheets

MEDIUM FEEDING DEVICE AND IMAGE FORMING APPARATUS

CROSS-REFERENCE TO RELATED APPLICATIONS

This application is based on and claims priority under 35 USC 119 from Japanese Patent Application No. 2011-160803 filed Jul. 22, 2011.

BACKGROUND

(i) Technical Field

The present invention relates to medium feeding devices and image forming apparatuses.

SUMMARY

According to an aspect of the invention, there is provided a medium feeding device including a container, a loading member, a holding member, a transport member, and a blocking unit. The container accommodates a medium. The loading member is supported within the container and loads the medium on a surface thereof. The holding member has a holding member body disposed facing the loading member and supported in a movable manner in a transport direction of the medium, gas suction openings formed in the holding member body, a peripheral member extending toward the loading member from the holding member body and disposed so as to surround the gas suction openings, a chamber formed within the peripheral member and surrounded by the peripheral member, and a suction unit that is connected to the gas suction openings and that performs gas suction. The holding member holds the medium by attracting the medium by suction to one end of the peripheral member facing the loading member as the suction unit performs the suction. The gas suction openings include a gas suction opening disposed inside an edge of the peripheral member and outside an edge of the medium. The transport member is disposed downstream of the holding member in the transport direction and transports the medium, attracted to the holding member by suction, downstream. The blocking unit blocks the suction of gas through the gas suction opening disposed inside the edge of the peripheral member and outside the edge of the medium.

BRIEF DESCRIPTION OF THE DRAWINGS

Exemplary embodiment(s) of the present invention will be described in detail based on the following figures, wherein.

DETAILED DESCRIPTION

Figure 1:
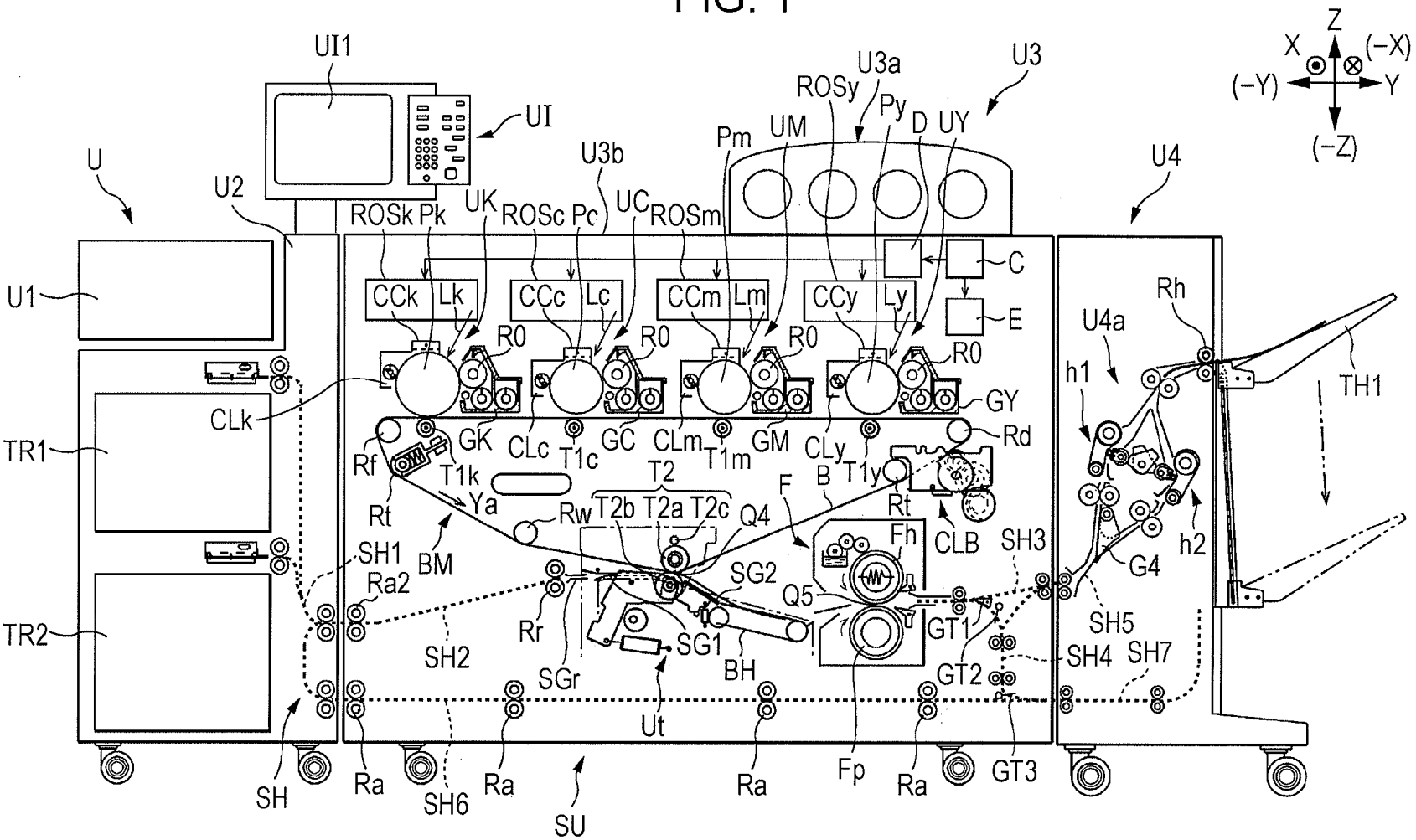
FIG. 1 is an overall view of an image forming apparatus according to a first exemplary embodiment of the present invention.

Although exemplary embodiments of the present invention will be described in detail below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 is an overall view of an image forming apparatus according to a first exemplary embodiment of the present invention.

Referring to FIG. 1, an image forming apparatus U includes a user interface UI as an example of an operating section, an image scanner U1 as an example of an image-information input unit, a feeding device U2 as an example of a medium feeding device, an image forming apparatus body U3, and a sheet processing device U4.

The user interface UI includes input keys as an example of an input section, such as a copy start key, a number-of-copies setting key, and a numerical keypad, and a display UI1.

The image scanner U1 is constituted of a scanner body as an example of an image reader, and an automatic document transport device that automatically transports a document. In FIG. 1, the image scanner U1 reads a document (not shown) and converts it into image information, and then inputs the image information to the image forming apparatus body U3.

The feeding device U2 includes multiple feed trays TR1 and TR2 as an example of containers and feeders, and a feed path SH1 along which recording paper S as an example of a medium fed from each of the feed trays TR1 and TR2 is transported toward the image forming apparatus body U3.

Referring to FIG. 1, the image forming apparatus body U3 includes an image recording unit that records an image onto the recording paper S transported from the feeding device U2, a toner dispenser U3*a* as an example of a developer supplier, a sheet transport path SH2, a sheet output path SH3, a sheet inversion path SH4, and a sheet circulation path SH6. The image recording unit will be described in detail later.

The image forming apparatus body U3 further includes a controller C, a laser driving circuit D as an example of a driving circuit for a latent-image writing unit controlled by the controller C, and a power circuit E controlled by the controller C. The laser driving circuit D controlled by the controller C outputs laser driving signals according to the image information for yellow (Y), magenta (M), cyan (C), and black (K) colors input from the image scanner U1 to latent-image forming units ROSy, ROSm, ROSc, and ROSk for the respective colors at a predetermined timing.

Referring to FIG. 1, a black-image bearing unit UK includes a photoconductor drum Pk as an example of an image bearing member, a charger CCk, and a photoconductor cleaner CLk as an example of an image-bearing-member cleaner. Likewise, image bearing units UY, UM, and UC for the remaining colors Y, M, and C respectively include photoconductor drums Py, Pm, and Pc, chargers CCy, CCm, and CCc as an example of dischargers, and photoconductor cleaners CLy, CLm, and CLc. In the first exemplary embodiment, the photoconductor drum Pk for the K color, which is frequently used and thus often experiences surface abrasion, is given a larger diameter than the photoconductor drums Py, Pm, and Pc for the remaining colors so as to allow for high-speed rotation and a longer lifespan.

The image bearing units UY, UM, UC, and UK and developing units GY, GM, GC, and GK having developing rollers R0 constitute toner-image forming members.

Referring to FIG. 1, the photoconductor drums Py, Pm, Pc, and Pk are electrostatically charged by the chargers CCy, CCm, CCc, and CCk, respectively, and electrostatic latent images are subsequently formed on the surfaces thereof by laser beams Ly, Lm, Lc, and Lk output as an example of latent-image write-in light from the latent-image forming units ROSy, ROSm, ROSc, and ROSk. The electrostatic latent images on the surfaces of the photoconductor drums Py, Pm, Pc, and Pk are developed into Y, M, C, and K toner images, as an example of visible images, by the developing units GY, GM, GC, and GK.

The toner images on the surfaces of the photoconductor drums Py, Pm, Pc, and Pk are sequentially superposed and transferred onto an intermediate transfer belt B as an example of an intermediate transfer body by first transfer rollers T1*y*, T1*m*, T1*c*, and T1*k* as an example of a first transfer unit, whereby a multi-color image, that is, a color image, is formed on the intermediate transfer belt B. The color image formed on the intermediate transfer belt B is transported to a second transfer region Q4 as an example of an image recording region.

In the case of black image data only, the photoconductor drum Pk and the developing unit GK for the black (K) color are used so that only a black toner image is formed.

After the first transfer process, residual toners on the surfaces of the photoconductor drums Py, Pm, Pc, and Pk are removed therefrom by the photoconductor cleaners CLy, CLm, CLc, and CLk.

A belt module BM as an example of an intermediate transfer unit is disposed below the image bearing units UY to UK. The belt module BM includes the aforementioned intermediate transfer belt B as an example of an intermediate transfer body, belt support rollers Rd, Rt, Rw, Rf, and T2*a* as an example of intermediate-transfer-body support members, and the aforementioned first transfer rollers T1*y*, T1*m*, T1*c*, and T1*k*. The belt support rollers Rd, Rt, Rw, Rf, and T2*a* include a belt driving roller Rd as an example of a driving member, a tension roller Rt as an example of a tension applying member, a working roller Rw as an example of a meander prevention member, multiple idler rollers Rf as an example of driven members, and a backup roller T2*a* as an example of an opposing member disposed opposite the second transfer region Q4. The intermediate transfer belt B is supported by the belt support rollers Rd, Rt, Rw, Rf, and T2*a* in a rotatable manner in a direction indicated by an arrow Ya.

A second transfer unit Ut is disposed below the backup roller T2*a*. The second transfer unit Ut includes a second transfer roller T2*b* as an example of a second transfer member. The second transfer roller T2*b* is disposed in a movable manner toward and away from the backup roller T2*a* with the intermediate transfer belt B interposed therebetween, and the second transfer region Q4 is formed in an area where the second transfer roller T2*b* comes into pressure contact with the intermediate transfer belt B. The backup roller T2*a* is in contact with a contact roller T2*c* as an example of a contact member for applying voltage. The rollers T2*a* to T2*c* constitute a second transfer device T2.

A second transfer voltage having the same polarity as the charge polarity of the toners is applied, at a predetermined timing, to the contact roller T2*c* from the power circuit E controlled by the controller C.

The sheet transport path SH2 is disposed below the belt module BM. The recording paper S fed from the feed path SH1 in the feeding device U2 is transported to the sheet transport path SH2 by transport rollers Ra as an example of multiple medium transport members. Then, a registration roller Rr as an example of a feed-timing adjustment member transports the recording paper S to the second transfer region Q4 via a medium guide member SGr and a pre-transfer medium guide member SG1 in accordance with the timing at which the toner images are to be transferred to the second transfer region Q4.

The toner images on the intermediate transfer belt B are transferred onto the recording paper S by the second transfer device T2 as the recording paper S travels through the second transfer region Q4. In the case of a full-color image, the toner images superposed and first-transferred on the surface of the intermediate transfer belt B are collectively second-transferred onto the recording paper S.

After the second transfer process, the intermediate transfer belt B is cleaned by a belt cleaner CLB as an example of an intermediate-transfer-body cleaner. The second transfer roller T2*b* is supported in a movable manner toward and away from the intermediate transfer belt B.

The first transfer rollers T1*y*, T1*m*, T1*c*, and T1*k*, the intermediate transfer belt B, the second transfer device T2, and the belt cleaner CLB constitute a transfer unit that transfers the images on the surfaces of the photoconductor drums Py to Pk onto the recording paper S.

The photoconductor drums Py, Pm, Pc, and Pk, the developing units GY, GM, GC, and GK, and the transfer unit constitute a printer unit U3*b* as an example of an image recording unit in the first exemplary embodiment.

The recording paper S having the superposed toner image second-transferred thereon is transported to a fixing unit F via a post-transfer medium guide member SG2 and a sheet transport belt BH as an example of a pre-fixation medium guide member. The fixing unit F includes a heating roller Fh as an example of a thermal fixing member and a pressing roller Fp as an example of a pressure fixing member. A fixing region Q5 is formed in an area where the heating roller Fh and the pressing roller Fp come into pressure contact with each other.

The toner image on the recording paper S is thermally fixed thereon by the fixing unit F as the recording paper S travels through the fixing region Q5. A first gate GT1 as an example of a transport-path switching member is provided downstream of the fixing unit F. The first gate GT1 selectively switches the transport path of the recording paper S, transported along the sheet transport path SH2 and having the image thermally fixed thereon in the fixing region Q5, to either the sheet inversion path SH4 or the sheet output path SH3 in the sheet processing device U4. The recording paper S transported to the sheet output path SH3 is transported to a sheet transport path SH5 in the sheet processing device U4.

A curl correction unit U4*a* as an example of a curve correction unit is disposed at an intermediate location of the sheet transport path SH5. A curl switch gate G4 as an example of a transport-path switching member is disposed in the sheet transport path SH5. The curl switch gate G4 transports the recording paper S transported from the sheet output path SH3 in the image forming apparatus body U3 to either a first curl correction member h1 or a second curl correction member h2, depending on the direction in which the recording paper S is curved or curled. The curl of the recording paper S transported to the first curl correction member h1 or the second curl correction member h2 is corrected as the recording paper S travels through the curl correction member. The recording paper S with its curl corrected is output by a sheet output roller Rh as an example of a sheet output member toward a sheet output tray TH1 as an example of a sheet output section of the sheet processing device U4 while the image fixed surface of the paper faces upward.

The recording paper S transported toward the sheet inversion path SH4 in the image forming apparatus body U3 by the first gate GT1 travels while pushing over a second gate GT2 as an example of a transport-direction regulation member constituted of an elastic thin-film member, so as to be transported to the sheet inversion path SH4 in the image forming apparatus body U3.

A downstream end of the sheet inversion path SH4 in the image forming apparatus body U3 is connected to the sheet circulation path SH6 and a sheet inversion path SH7, and a third gate GT3 as an example of a transport-direction regulation member is disposed at the connection point between the sheet inversion path SH4, the sheet circulation path SH6, and the sheet inversion path SH7. The recording paper S transported to the sheet inversion path SH4 via the first gate GT1 travels through the third gate GT3 so as to be transported toward the sheet inversion path SH7 in the sheet processing device U4. In a case where duplex printing is to be performed, the recording paper S transported along the sheet inversion path SH4 is transported to the sheet inversion path SH7 directly via the third gate GT3, and is subsequently transported in the reverse direction so as to be switched back. Then, the third gate GT3 regulates the transport direction of the recording paper S so that the switched-back recording paper S is transported toward the sheet circulation path SH6. The recording paper S transported to the sheet circulation path SH6 is transported again to the second transfer region Q4 via the feed path SH1.

After the trailing edge of the recording paper S passes through the second gate GT2, the recording paper S transported along the sheet inversion path SH4 is switched back before passing through the third gate GT3. Then, the second gate GT2 regulates the transport direction of the recording paper S so that the recording paper S with its front and back faces in an inverted state is transported to the sheet transport path SH5. The inverted recording paper S has its curl corrected by the curl correction unit U4*a* and is subsequently output onto the sheet output tray TH1 in the sheet processing device U4 while the image fixed surface of the recording paper S faces downward.

The components denoted by the reference characters SH1 to SH7 constitute a sheet transport path SH. Furthermore, the components denoted by the reference characters SH, Ra, Rr, Rh, SGr, SG1, SG2, BH, and GT1 to GT3 constitute a medium transport unit SU.

Figure 2:
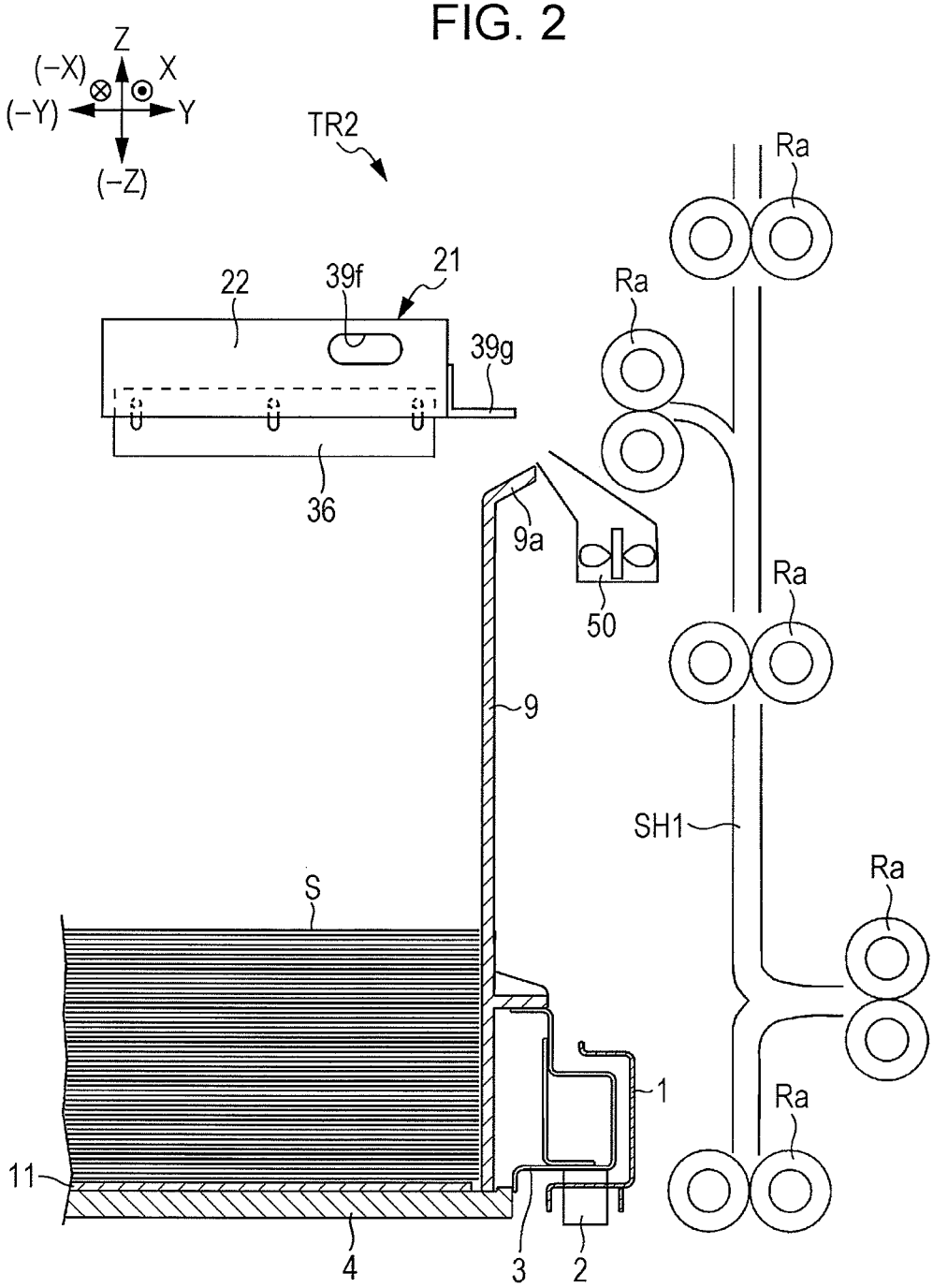
FIG. 2 is an enlarged view showing a relevant part of a feed tray according to the first exemplary embodiment.

FIG. 2 is an enlarged view showing a relevant part of each of the feed trays in the first exemplary embodiment.

With regard to the feed trays TR1 and TR2 in the first exemplary embodiment, only a specific description of the second feed tray TR2 will be provided below, and a specific description of the feed tray TR1 will be omitted since it has a configuration similar to that of the feed tray TR2.

Referring to FIG. 2, rails 1 as an example of guide members extending in the front-rear direction, that is, the X-axis direction, are disposed on the left and right ends of the second feed tray TR2. The lower surface of each rail 1 rotatably supports a roller 2 as an example of a rotatable member. An upper portion of the roller 2 protrudes upward from the rail 1 through a hole formed in the lower surface of the rail 1.

Guided rails 3 as an example of guided members that protrude outward extend in the front-rear direction along lower left and right sides of each of the feed trays TR1 and TR2. The guided rails 3 are supported by the upper surfaces of the rollers 2 located at the lower surfaces of the rails 1. Therefore, the second feed tray TR2 is insertable and ejectable in the front-rear direction along the left and right rails 1. Specifically, the second feed tray TR2 is movable between an ejected position at which the second feed tray TR2 is ejected from the feeding device U2 and an inserted position at which the second feed tray TR2 is inserted in the feeding device U2.

Figure 3:
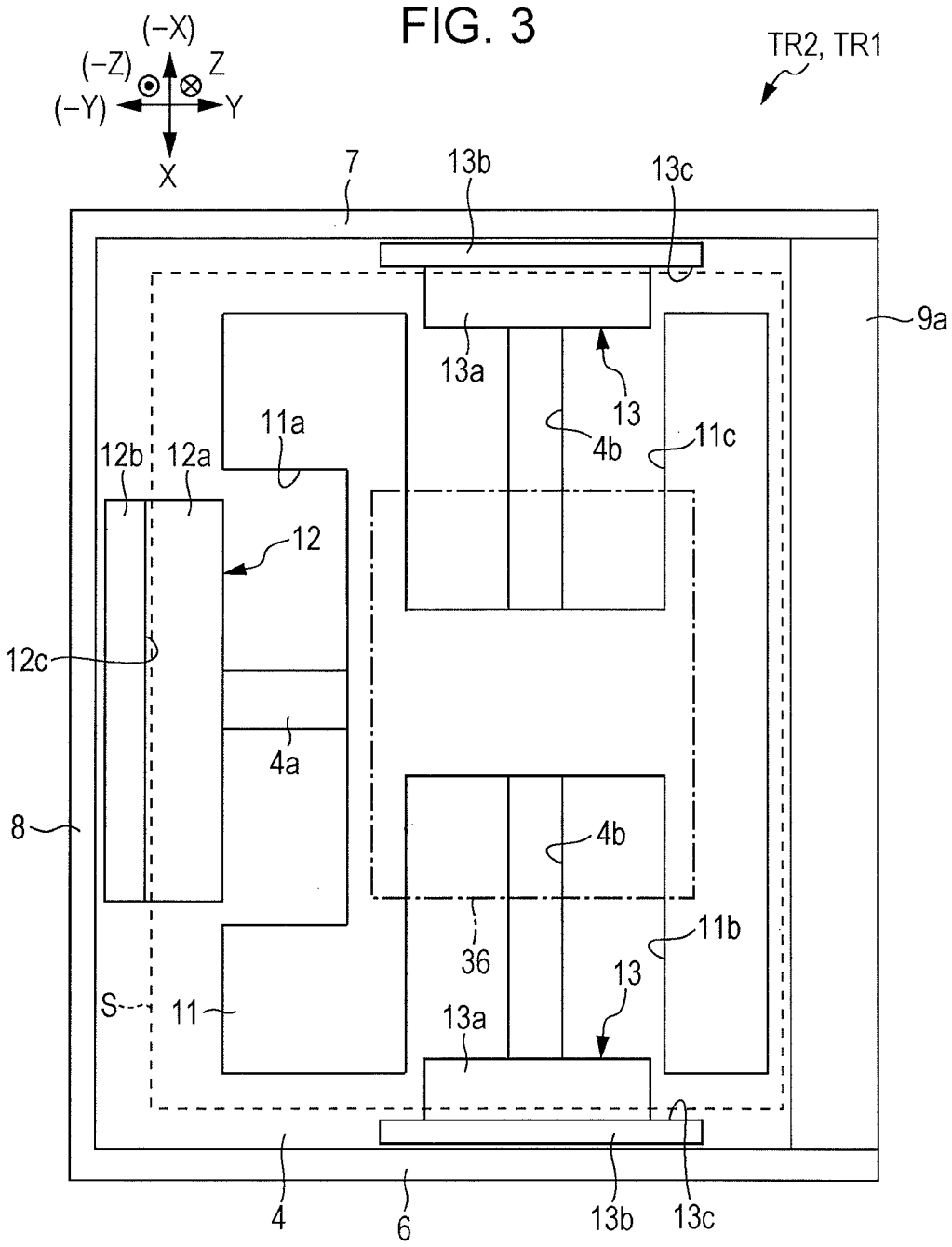
FIG. 3 is a plan view of the feed tray according to the first exemplary embodiment.

FIG. 3 is a plan view of each of the feed trays in the first exemplary embodiment.

Referring to FIGS. 2 and 3, the second feed tray TR2 has a base plate 4, and a front wall 6, a rear wall 7, a left wall 8, and a right wall 9 that extend upward so as to surround the front, rear, left, and right sides of the base plate 4. Referring to FIG. 3, a left portion of the base plate 4 of the second feed tray TR2 is provided with an end guide groove 4*a* as an example of a first guide extending in the left-right direction, and a right portion of the base plate 4 is provided with side guide grooves 4*b* as an example of second guides extending in the front-rear direction. Referring to FIGS. 2 and 3, the upper end of the right wall 9 is provided with an inclined portion 9*a* that is inclined rightward and upward. The inclined portion 9*a* guides the recording paper S to be fed toward the transport rollers Ra.

A flat loading plate 11 as an example of a loading member that loads the recording paper S thereon is disposed on the upper surface of the base plate 4. The loading plate 11 has a left opening 11*a* that extends from the left side toward the middle in correspondence with the end guide groove 4*a*, and a front opening 11*b* and a rear opening 11*c* that extend from the front and rear ends toward the middle in correspondence with the side guide grooves 4*b*. The loading plate 11 in the first exemplary embodiment is movable upward and downward by a lifting/lowering mechanism that uses a wire as an example of a linear member (not shown). Specifically, the loading plate 11 is movable between a lowered position for loading the recording paper S and a lifted position for feeding the recording paper S. Since the lifting/lowering mechanism using a wire for lifting or lowering the recording paper S may be based on a related art technique, and related-art configurations are applicable thereto, a detailed description thereof is omitted.

In the end guide groove 4*a*, an end guide 12 as an example of a first edge alignment member is supported in a movable manner in the left-right direction along the end guide groove 4*a*. The end guide 12 is substantially L-shaped, as viewed from the front, and includes a flat-plate-shaped slidable segment 12*a* as an example of a movable segment extending along the base plate 4, and an end guide body 12*b* as an example of an alignment body extending upward from the left end of the slidable segment 12*a*. A right side surface of the end guide body 12*b* is provided with a contact surface 12*c* that is contactable with the left edge of the recording paper S placed on the loading plate 11. When the left edge of the recording paper S comes into contact with the contact surface 12*c*, the left edges of stacked sheets of recording paper S are aligned.

In the side guide grooves 4*b*, front and rear side guides 13 forming a pair as an example of second edge alignment members are supported in a movable manner in the front-rear direction along the corresponding side guide grooves 4*b*. Similar to the end guide 12, the side guides 13 each include a slidable segment 13*a* and a side guide body 13*b*. Inner side surfaces of the side guide bodies 13*b* are provided with contact surfaces 13*c* that are contactable with the front and rear edges of the recording paper S.

The two side guides 13 are movable toward and away from each other in conjunction with each other by a rack gear having a gear on a flat plate thereof and a pinion gear as an example of a gear (not shown). Since the configuration for moving the side guides 13 toward and away from each other in conjunction with each other by using the rack gear and the pinion gear may be based on a related art technique, and related-art configurations are applicable thereto, a detailed description thereof is omitted.

Therefore, when the side guides 13 move toward and away from each other so as to come into contact with the edges of the recording paper S, the front and rear edges of the stacked sheets of recording paper S are aligned.

Figure 4A:
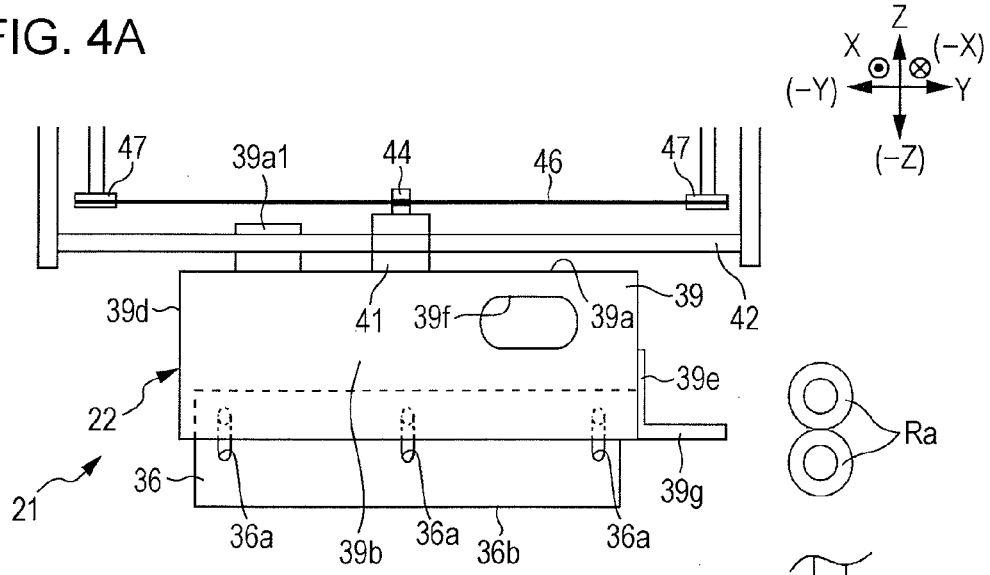
FIGS. 4A and 4B illustrate a suction head according to the first exemplary embodiment, FIG. 4A being a front view thereof, FIG. 4B being a plan view thereof.
Figure 4B:
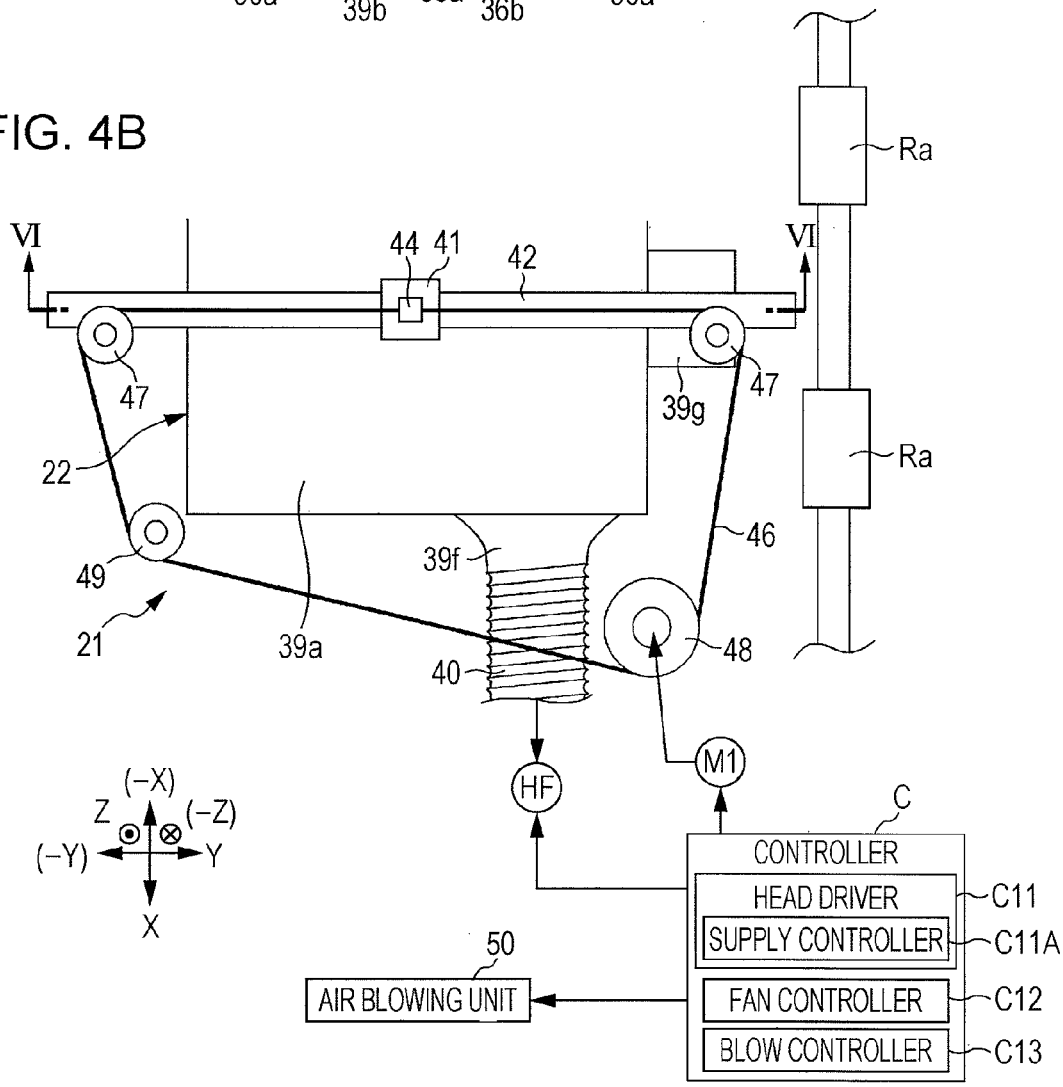

FIGS. 4A and 4B illustrate a suction head according to the first exemplary embodiment. Specifically, FIG. 4A is a front view of the suction head, and FIG. 4B is a plan view thereof.

Figure 5:
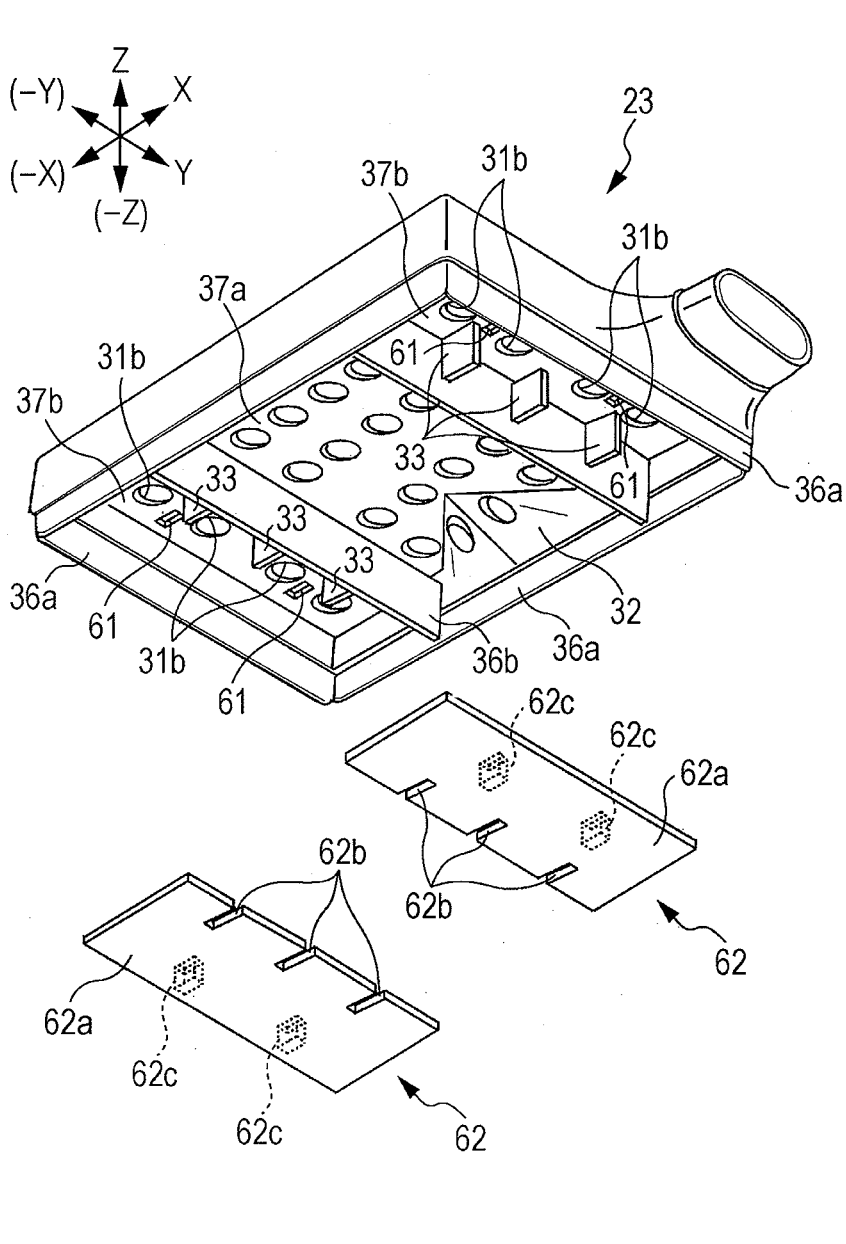
FIG. 5 is a perspective view of the suction head according to the first exemplary embodiment, as viewed at an angle from below.

FIG. 5 is a perspective view of the suction head according to the first exemplary embodiment, as viewed at an angle from below.

Figure 6:
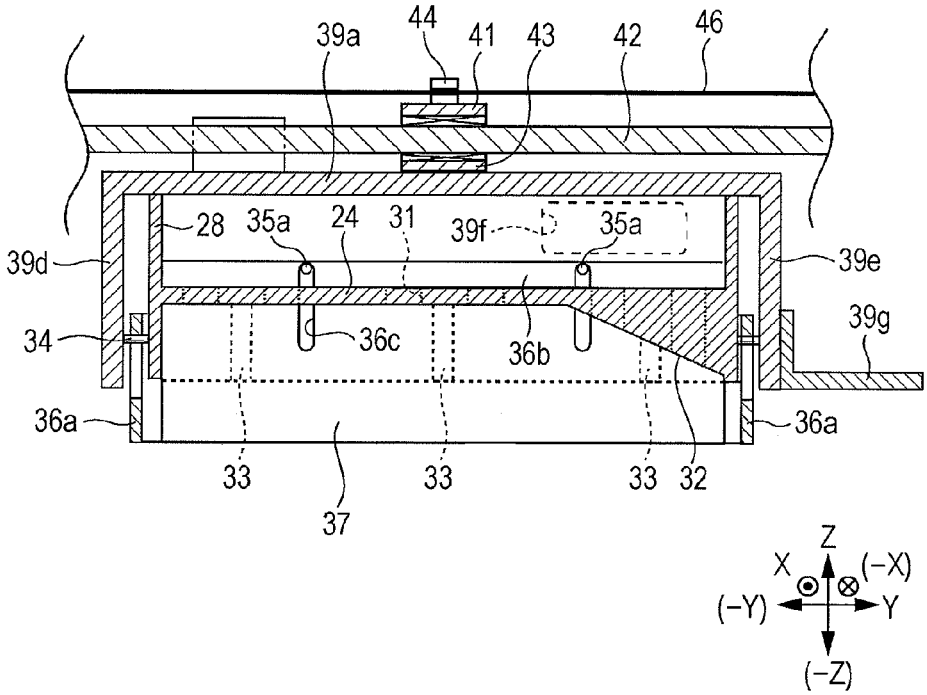
FIG. 6 is a cross-sectional view taken along line VI-VI in FIG. 4B.

FIG. 6 is a cross-sectional view taken along line VI-VI in FIG. 4B.

Referring to FIG. 2 and FIGS. 4A to 6, a sheet fetching unit 21 as an example of a medium fetching member is disposed above the second feed tray TR2. The sheet fetching unit 21 has a suction head 22 as an example of a holding member that is capable of holding the recording paper S by suctioning the recording paper S from the loading plate 11. The suction head 22 has a box-shaped head body 23 as an example of a holding member body. The head body 23 has a flat base plate 24 and sidewalls 26, 27, 28, and 29 extending vertically from front, rear, left, and right edges of the base plate 24.

Figure 7:
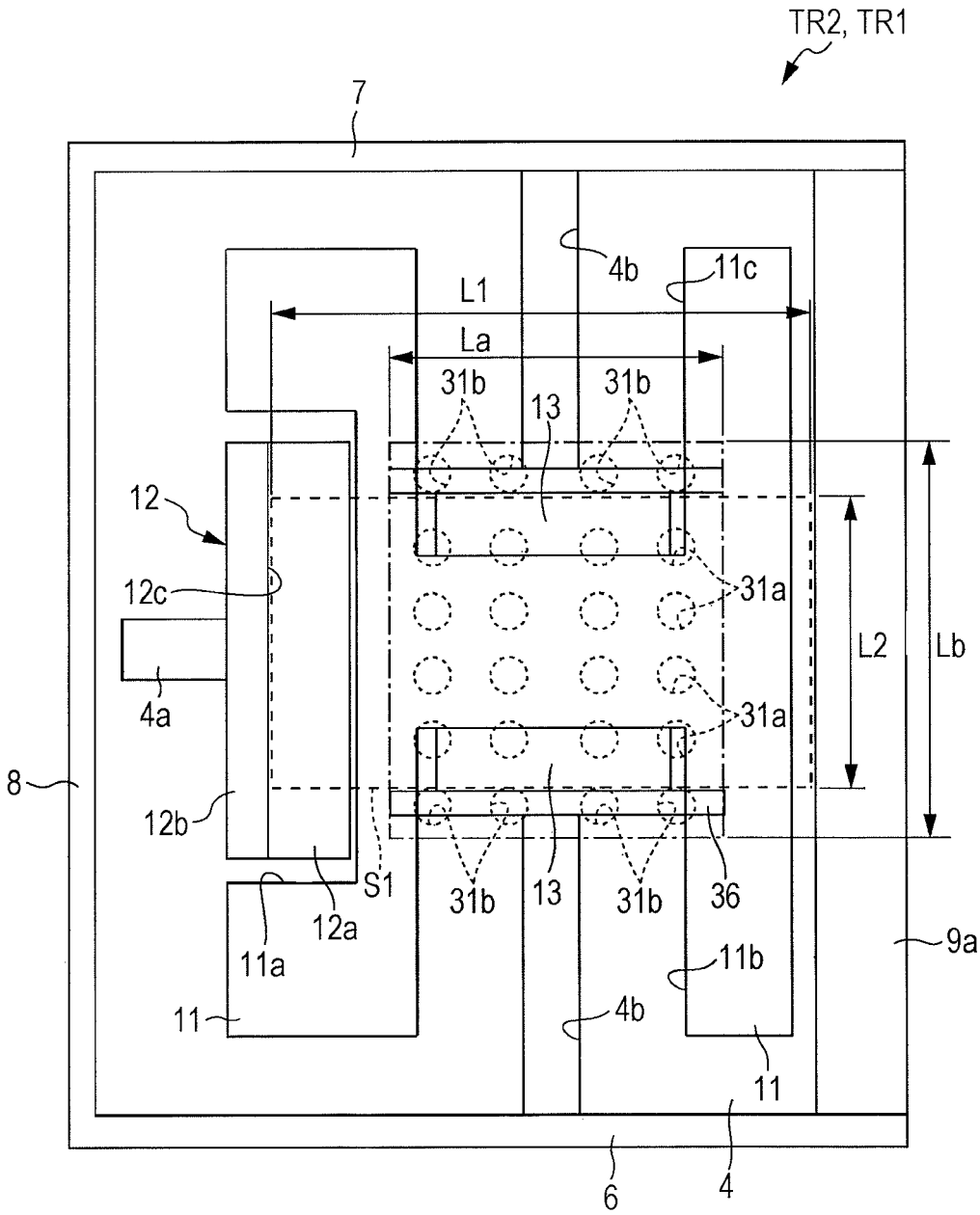
FIG. 7 illustrates the suction head according to the first exemplary embodiment and is a plan view showing a state where a minimum-size medium is accommodated.

FIG. 7 illustrates the suction head 22 according to the first exemplary embodiment and is a plan view showing a state where a minimum-size medium is accommodated.

The base plate 24 is provided with multiple suction ports 31 as an example of gas-suction openings extending in the up-down direction. The suction ports 31 include inner suction ports 31*a* as an example of first suction ports disposed in an intermediate area of the head body 23, and outer suction ports 31*b* as an example of second suction ports disposed at the outer sides of the head body 23 in the front-rear direction thereof. Referring to FIG. 7, the inner suction ports 31*a* in the first exemplary embodiment are disposed within the width, as viewed in the front-rear direction, of a postcard S1 as an example of a minimum-size medium that can be used in the image forming apparatus U, whereas the outer suction ports 31*b* are disposed outside the width of the postcard S1 in the front-rear direction.

Figure 8A:
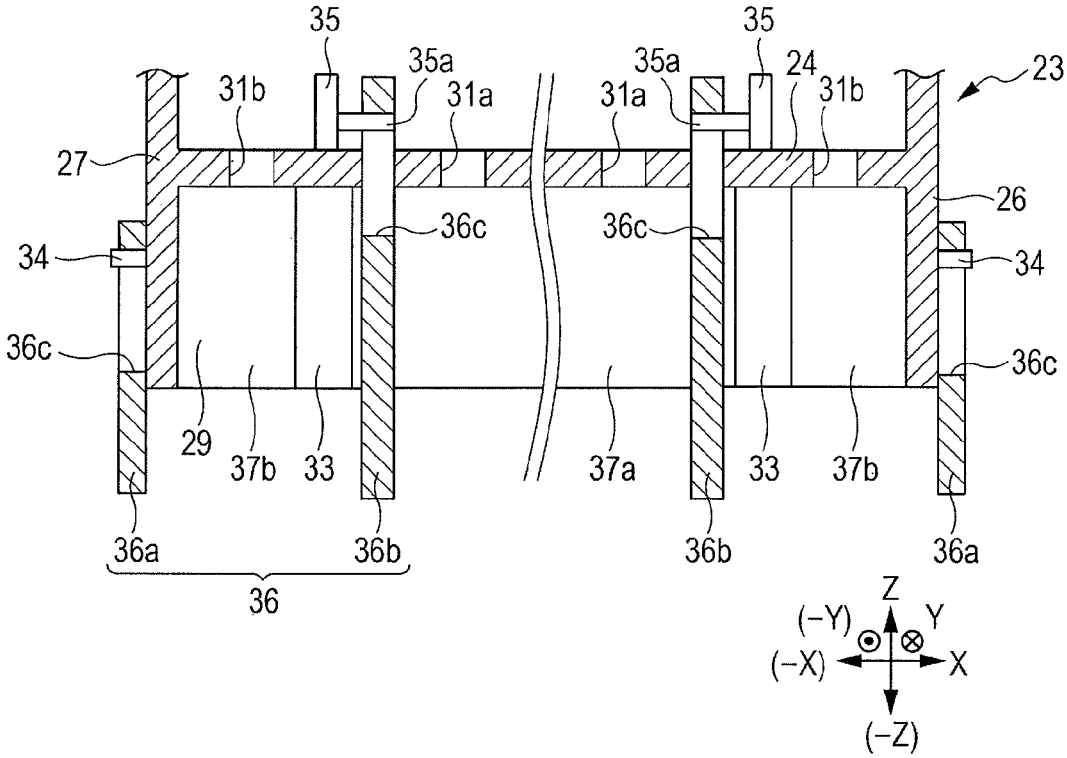
FIGS. 8A and 8B are diagrams for explaining a blocking unit according to the first exemplary embodiment, FIG. 8A showing a state where the blocking unit is removed, FIG. 8B showing a state where the blocking unit is attached.
Figure 8B:
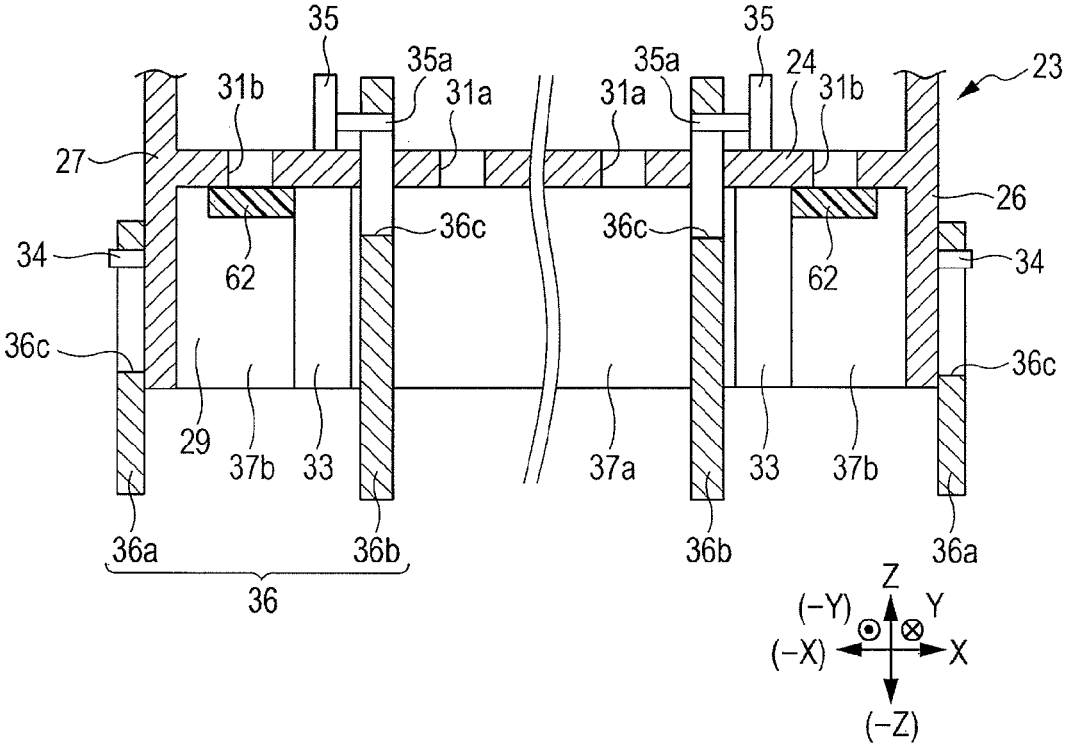

FIGS. 8A and 8B are diagrams for explaining a blocking unit according to the first exemplary embodiment. Specifically, FIG. 8A shows a state where the blocking unit is removed, and FIG. 8B shows a state where the blocking unit is attached.

A right portion of the lower surface of the base plate 24 is provided with an inclined surface 32 as an example of a bending section. The inclined surface 32 is inclined downward toward the right side and is also inclined leftward toward the middle in the front-rear direction. The front and rear ends of the lower surface of the base plate 24 are provided with downwardly-extending plate-shaped ribs 33 as an example of bending sections that are spaced apart from each other.

Referring to FIGS. 4A, 6, 8A, and 8B, the outer surfaces of the sidewalls 26 to 29 support multiple outer pins 34 as an example of first peripheral support members that protrude outward. Furthermore, referring to FIGS. 8A and 8B, the upper surface of the base plate 24 supports upwardly-extending support walls 35 disposed between the inner suction ports 31*a* and the outer suction ports 31*b*. The support walls 35 support multiple inwardly-protruding inner pins 35*a* as an example of second peripheral support members.

Referring to FIGS. 4A, 5, and 6, a plate-shaped seal skirt 36 as an example of a peripheral member extends downward from the outer surface of the head body 23. The seal skirt 36 in the first exemplary embodiment includes four front, rear, left, and right outer skirts 36*a* as an example of first peripheral members that are supported by the outer pins 34 so as to surround the outer periphery of the head body 23, and a pair of front and rear inner skirts 36*b* as an example of second peripheral members that are supported by the inner pins 35*a* so as to extend from one end toward the other end of the head body 23 in the left-right direction.

In the first exemplary embodiment, a length La of the outer skirts 36*a* of the suction head 22 in the transport direction of the postcard S1 is smaller than a length L1 of the postcard S1 in the transport direction. Furthermore, a length Lb of the outer skirts 36*a* of the suction head 22 in the width direction of the postcard S1 is larger than a length L2 of the postcard S1 in the width direction. Specifically, in the first exemplary embodiment, the following relationships are satisfied: L1>La and L2<Lb. Therefore, the outer skirts 36*a* in the first exemplary embodiment are disposed outside the outer edges of the postcard S1 in the width direction, and the inner skirts 36*b* are disposed inside the outer edges of the postcard S1 in the width direction.

The skirts 36*a* and 36*b* are provided with vertically-extending long holes 36*c* at positions corresponding to the pins 34 and 35*a*. The pins 34 and 35*a* are inserted into the corresponding long holes 36*c* so as to be supported therein. Therefore, the seal skirt 36 in the first exemplary embodiment is supported in a movable manner in the up-down direction relative to the head body 23, that is, in a direction in which the seal skirt 36 moves toward and away from the loading plate 11 and the recording paper S placed thereon.

Consequently, the suction ports 31 are disposed in an area surrounded by the seal skirt 36 and the sidewalls 26 to 29, and a space surrounded by the seal skirt 36, the lower surface of the base plate 24, and the sidewalls 26 to 29 forms a suction chamber 37 in the first exemplary embodiment. The suction chamber 37 in the first exemplary embodiment is substantially partitioned into an inner chamber and outer chambers by the inner skirts 36*b*. Specifically, the suction chamber 37 includes an inner suction chamber 37*a* as an example of a first chamber surrounded by the seal skirt 36 within the inner skirts 36*b*, and outer suction chambers 37*b* as an example of second chambers surrounded by the inner skirts 36*b* and the outer skirts 36*a*.

An upper portion of the head body 23 supports a cover 39 as an example of a cover member. The cover 39 includes an upper plate 39*a* covering the upper side of the space surrounded by the base plate 24 and the sidewalls 26 to 29, and side plates 39*b*, 39*c*, 39*d*, and 39*e* extending downward from front, rear, left, and right edges of the upper plate 39*a*. Referring to FIGS. 4B to 5, a right portion of the front side plate 39*b* is provided with an exhaust duct 39*f* as an example of a connection section extending forward. The exhaust duct 39*f* is connected to one end of a bellows member 40 as an example of a flexible member. The other end of the bellows member 40 is connected to an exhaust fan HF as an example of a suction unit.

Therefore, the exhaust fan HF is connected to the suction ports 31 via the exhaust duct 39*f*, the bellows member 40, and an exhaust port 26*a* as an example of an opening formed in the front sidewall 26. When the exhaust fan HF is actuated, gas, that is, air, in the suction chamber 37 is exhausted through the suction ports 31.

The components denoted by the reference numerals 23 to 39 constitute the suction head 22 according to the first exemplary embodiment.

Referring to FIGS. 4A to 6, the right side plate 39*e* of the cover 39 supports a plate-shaped leading-edge sheet guide 39*g* extending rightward as an example of a leading-edge supporter. The length, in the front-rear direction, of the leading-edge sheet guide 39*g* in the first exemplary embodiment is set such that the leading-edge sheet guide 39*g* can travel between the transport rollers Ra spaced apart from each other in the front-rear direction.

The transport rollers Ra in the first exemplary embodiment are disposed such that at least a portion of the rollers is included within the outer edges of the head body 23 in the front-rear direction. The distance between the inner ends of the transport rollers Ra is smaller than the width of minimum-size recording paper S. Therefore, even when such minimum-size recording paper S is to be fed, the transport rollers Ra can nip and transport the recording paper S downstream.

The upper surface of the cover 39 supports a shaft guide 41 as an example of a guided section. A guide shaft 42 as an example of a guide member supported by the feeding device U2 and extending in the left-right direction, which is the medium transport direction, passes through the shaft guide 41. The shaft guide 41 in the first exemplary embodiment is supported in a non-rotatable state in a movable manner in the left-right direction along the guide shaft 42 via a linear ball bearing 43 as an example of a bearing member.

The upper surface of the shaft guide 41 supports a wire fixing section 44 as an example of a coupling member. The wire fixing section 44 securely supports a wire 46 as an example of a wire member. The wire 46 is extended around a pair of pulleys 47 disposed at the left and right sides of the wire fixing section 44, a driving pulley 48, and a driven pulley 49 as an example of supporters. The driving pulley 48 receives a rotational force from a motor M1 as an example of a driving source that is rotatable in forward and reverse directions. Therefore, in response to forward or reverse rotation of the motor M1, the wire 46 rotates clockwise or counterclockwise in FIG. 4B, causing the suction head 22 to move in the left-right direction along the guide shaft 42.

Referring to FIG. 2, an air blowing unit 50 as an example of a medium separating unit that blows air for medium separation toward the suction head 22 from below is disposed between the suction head 22 and the transport rollers Ra. Since the configuration for separating media from each other by blowing air thereto is may be based on a related art technique, and related-art configurations are applicable thereto, a detailed description thereof is omitted.

The wire 46, the pulleys 47 to 49, and the motor M1 constitute a head driving unit according to the first exemplary embodiment as an example of a holding-member driving unit. Furthermore, the suction head 22, the bellows member 40, the exhaust fan HF, the head driving unit, and the air blowing unit 50 constitute the sheet fetching unit 21 according to the first exemplary embodiment.

Referring to FIGS. 4A and 4B, the controller C of the image forming apparatus U according to the first exemplary embodiment includes a feed controller Cl that controls the feeding device U2. The feed controller Cl includes a head driver C11 as an example of a transport controller, a fan controller C12 as an example of a suction controller, and a blow controller C13 as an example of a separation controller.

The head driver C11 includes a supply controller C11A and controls the forward and reverse rotation of the motor M1 so as to drive the suction head 22 and control the position thereof.

When the recording paper S is to be fed, the supply controller C11A rotates the motor M1 in the forward or reverse direction on the basis of a feed timing of the recording paper S so as to move the suction head 22 between a suction position and a feed position.

The fan controller C12 controls the exhaust fan HF so as to cause the recording paper S to become attracted to the suction head 22 by suction. When feeding operation commences and the recording paper S is to become attracted to the suction head 22 by suction, the fan controller C12 in the first exemplary embodiment actuates the exhaust fan HF so as to start the suction attracting process for the recording paper S. When it is determined that the suction head 22 has moved to the feed position, the fan controller C12 stops the exhaust fan HF.

The blow controller C13 controls the air blowing unit 50 so as to blow air to the recording paper S attracted to the suction head 22 by suction, whereby the recording paper S becomes separated from the remaining sheets of recording paper S and is fed. When a predetermined blow start time period t3 elapses from the start of the suction process by the fan controller C12, the blow controller C13 in the first exemplary embodiment actuates the air blowing unit 50 to start the air blowing process. When a predetermined blowing time period t4 elapses from the start of the air blowing process, the blow controller C13 stops the air blowing process. In the first exemplary embodiment, the blow start time period t3 is preliminarily measured and determined from tests and is set to a time period extending from when the exhaust fan HF is actuated to when the seal skirt 36 ascends to the upper end. The predetermined blowing time period t4 is preliminarily measured and determined from tests and is set to a time period in which the recording paper S is sufficiently separable from the remaining sheets of recording paper S by blowing air thereto.

Referring to FIG. 5, the front and rear ends of the base plate 24 of the head body 23 are each provided with a pair of left and right shutter support holes 61 as an example of attachment sections.

Referring to FIGS. 5, 8A, and 8B, the image forming apparatus U according to the first exemplary embodiment includes a pair of front and rear shutter plates 62, as an example of blocking members included in the blocking unit, that are detachably attached to the head body 23. Referring to FIG. 5, the shutter plates 62 each have a plate-shaped shutter body 62*a* that can close the corresponding outer suction ports 31*b* when the shutter plate 62 is attached to the head body 23. The shutter bodies 62*a* are provided with notches 62*b* at positions corresponding to the ribs 33. Each shutter body 62*a* is also provided with a pair of left and right claw segments 62*c* as an example of attachment sections at positions corresponding to the shutter support holes 61. The shutter plates 62 in the first exemplary embodiment are formed by integral molding using a resinous material, such as plastic, and the claw segments 62*c* are elastically deformable.

Therefore, when the shutter plates 62 are attached to the head body 23, the claw segments 62*c* become temporarily elastically deformed as the claw segments 62*c* are inserted into the shutter support holes 61. When the terminal ends of the claw segments 62*c* pass through the shutter support holes 61, the claw segments 62*c* elastically recover their original state so as to become hooked onto the upper edges of the shutter support holes 61, whereby the shutter plates 62 are attached to the head body 23. When the shutter plates 62 are detached from the head body 23, the claw segments 62*c* and the shutter bodies 62*a* become elastically deformed as the shutter plates 62 are pulled downward. Thus, the claw segments 62*c* are removed from the shutter support holes 61, whereby the shutter plates 62 are detached from the head body 23.

Therefore, the shutter plates 62 in the first exemplary embodiment are detachably attached to the head body 23 based on a so-called snap-fit structure.

When using the postcard S1, which is a kind of a medium whose length in the width direction thereof is smaller than the length of the outer skirts 36*a* in the width direction, the shutter plates 62 in the first exemplary embodiment are attached to the head body 23.

Figure 9A:
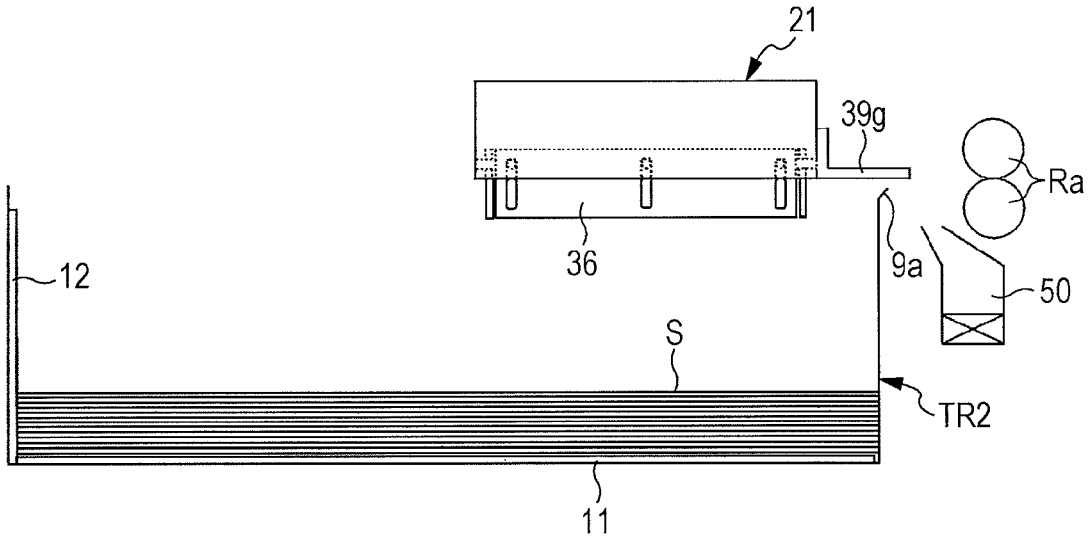
FIGS. 9A and 9B are diagrams for explaining the operation of the first exemplary embodiment when large-size sheets are to be fed, FIG. 9A illustrating the feed tray in a state where a loading plate is moved to a lowered position prior to the start of image forming operation, FIG. 9B illustrating a state where the loading plate is moved to a lifted position when the image forming operation is commenced.
Figure 9B:
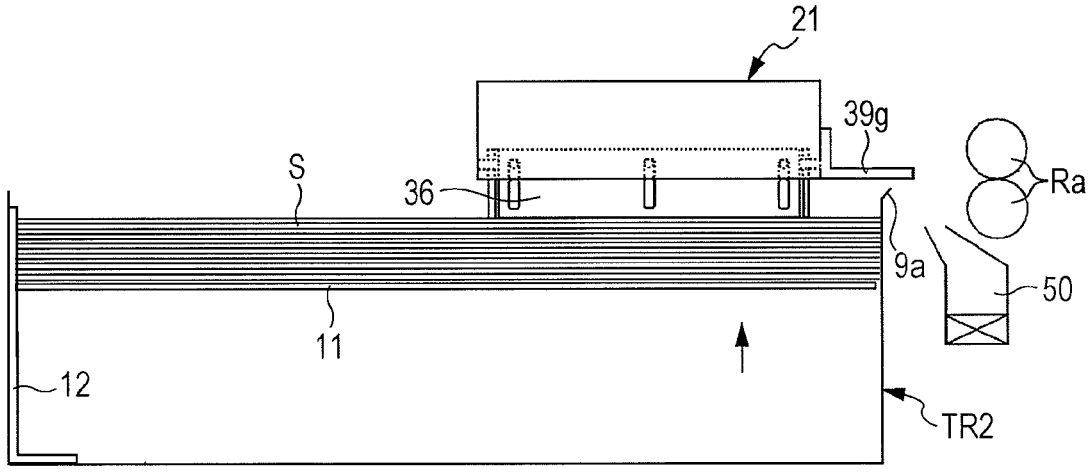

FIGS. 9A and 9B are diagrams for explaining the operation of the first exemplary embodiment when large-size sheets are to be fed. Specifically, FIG. 9A illustrates the feed tray TR2 in a state where the loading plate 11 is moved to the lowered position prior to the start of image forming operation, and FIG. 9B illustrates a state where the loading plate 11 is moved to the lifted position when the image forming operation is commenced.

In the image forming apparatus U according to the first exemplary embodiment having the above-described configuration, the loading plate 11 in each of the feed trays TR1 and TR2 is moved to the lowered position before the start of a job for image forming operation, and the suction head 22 is moved to the suction position, as shown in FIG. 9A. In a case where the recording paper S used is a large-size sheet whose width and length are larger than those of the suction head 22, as shown in FIG. 3, when the job commences, the loading plate 11 is lifted to the lifted position shown in FIG. 9B so that the uppermost sheet of the stacked sheets of recording paper S on the loading plate 11 is set adjacent to the lower end of the seal skirt 36.

Figure 10A:
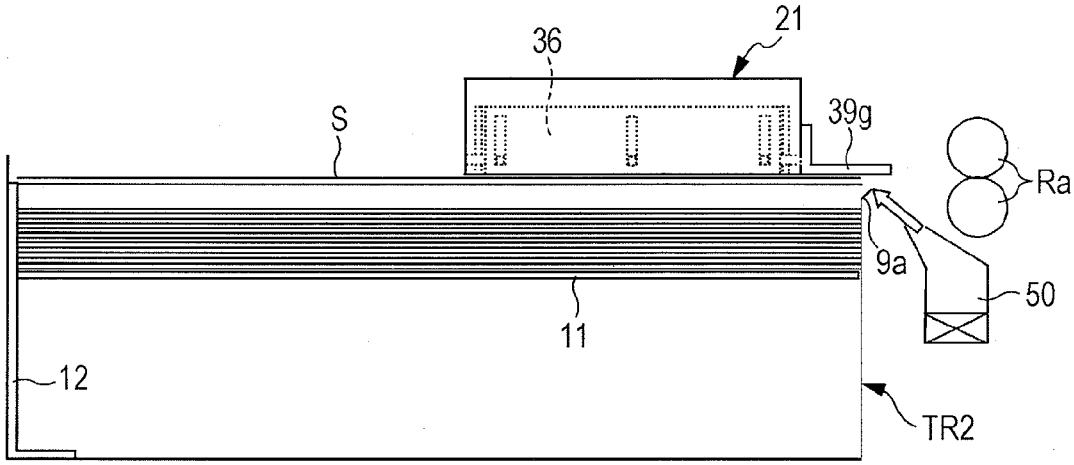
FIGS. 10A and 10B are diagrams for explaining the operation of the first exemplary embodiment when large-size sheets are to be fed, FIG. 10A illustrating a state where sheets are attracted to the suction head by suction from the state shown in FIG. 9B and air for medium separation is blown thereto, FIG. 10B illustrating a state where the suction head is moved from a suction position to a feed position from the state shown in FIG. 10A.
Figure 10B:
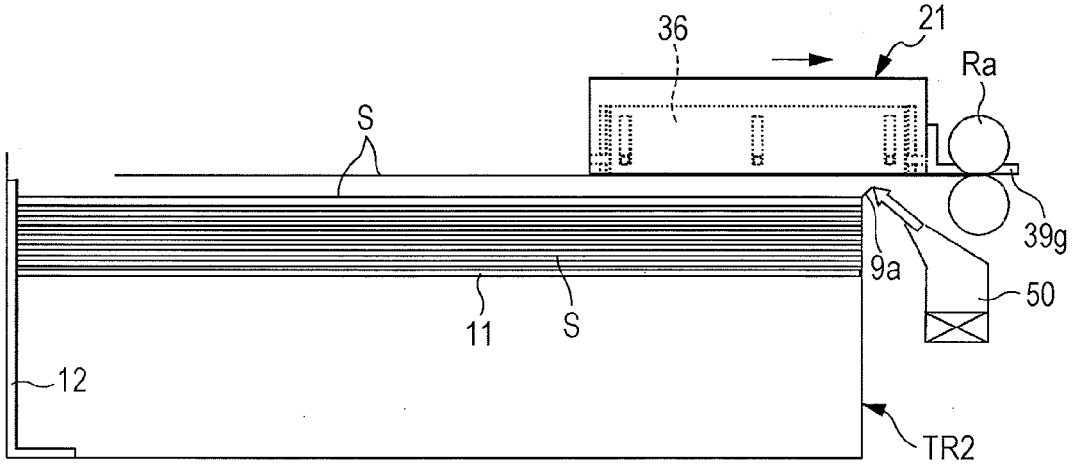

FIGS. 10A and 10B are diagrams for explaining the operation of the first exemplary embodiment when large-size sheets are to be fed. Specifically, FIG. 10A illustrates a state where sheets are attracted to the suction head 22 by suction from the state shown in FIG. 9B and air for medium separation is blown thereto, and FIG. 10B illustrates a state where the suction head 22 is moved from the suction position to the feed position from the state shown in FIG. 10A.

Subsequently, when the exhaust fan HF is actuated so as to suction the air from the suction chamber 37, the uppermost recording paper S becomes attracted to the lower end of the seal skirt 36 by suction, causing the suction chamber 37 to become substantially sealed. Specifically, the flow of gas into the suction chamber 37 from the outside is limited.

As the air in the suction chamber 37 is further exhausted therefrom in this state, the suction chamber 37 changes into a low-pressure state. Thus, the recording paper S ascends together with the seal skirt 36, thereby obtaining the state shown in FIG. 10A.

In this case, one or more sheets of recording paper S may sometimes stick to the lower surface of the uppermost sheet of recording paper S due to static electricity or the like so as to ascend together therewith. In the image forming apparatus U according to the first exemplary embodiment, the air blowing unit 50 is also actuated as the exhaust process for the suction chamber 37 commences, so that air is blown onto the multiple sheets of recording paper S.

With regard to the sheets of recording paper S ascending together with the seal skirt 36, when the exhaust process is further performed in a state where the seal skirt 36 has moved to the upper end, the sheets of recording paper S may bend and undulate by coming into contact with the inclined surface 32 or the ribs 33. The degree of undulation in the recording paper S varies between the uppermost sheet of recording paper S and the remaining one or more sheets of recording paper S disposed therebelow, thus creating a gap therebetween. Therefore, air is blown into the gap between the sheets of recording paper S so that the remaining one or more sheets of recording paper S become separated from the uppermost sheet of recording paper S and fall onto the loading plate 11.

In the suction head 22 according to the first exemplary embodiment, the upper side of the leading edge of the recording paper S is supported by the leading-edge sheet guide 39*g* even when air is blown onto the recording paper S, thereby reducing the amount of upward curl or curve in the recording paper S.

The recording paper S attracted to the suction head 22 by suction moves forward together with the suction head 22 moving from the suction position shown in FIG. 10A to the feed position shown in FIG. 10B. Then, the leading edge of the recording paper S in the transport direction reaches the transport rollers Ra while being guided by the leading-edge sheet guide 39*g*, whereby the recording paper S is transported downstream by the rotation of the transport rollers Ra.

Figure 11A:
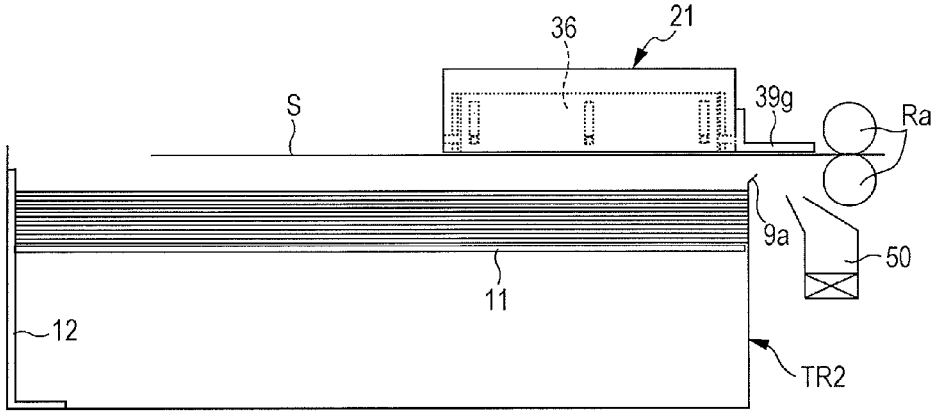
FIGS. 11A and 11B are diagrams for explaining the operation of the first exemplary embodiment when large-size sheets are to be fed, FIG. 11A illustrating a state where the suction head starts moving toward the suction position from the state shown in FIG. 10B, FIG. 11B illustrating a state where the suction head has reached the suction position by moving further from the state shown in FIG. 11A.
Figure 11B:
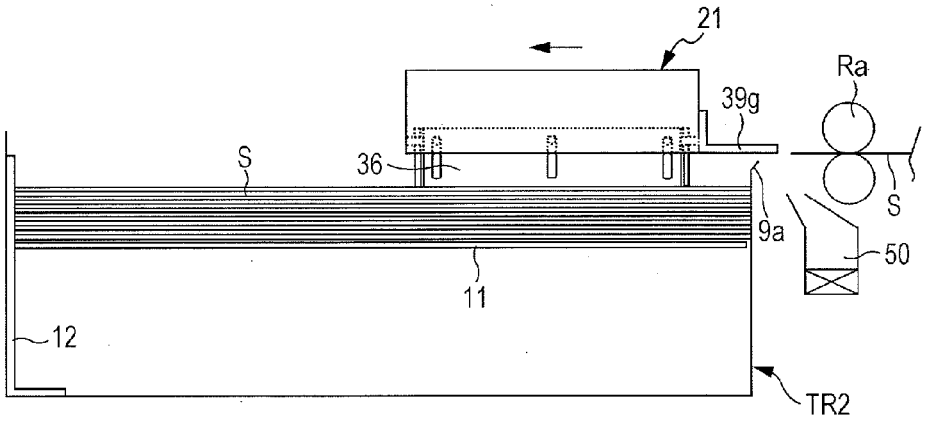

FIGS. 11A and 11B are diagrams for explaining the operation of the first exemplary embodiment when large-size sheets are to be fed. Specifically, FIG. 11A illustrates a state where the suction head 22 starts moving toward the suction position from the state shown in FIG. 10B, and FIG. 11B illustrates a state where the suction head 22 has reached the suction position by moving further from the state shown in FIG. 11A.

Referring to FIGS. 10B and 11A, when the recording paper S reaches the transport rollers Ra so as to be transported downstream, the exhaust process for the suction chamber 37 is discontinued by stopping the exhaust fan HF, and the suction head 22 starts moving back toward the suction position.

Referring to FIGS. 11A and 11B, when the recording paper S is transported downstream and the trailing edge thereof passes the seal skirt 36, the sealed state of the suction chamber 37 is canceled so that the air pressure therein is set back to the atmospheric pressure, causing the seal skirt 36 to descend due to gravity. Consequently, the state shown in FIG. 9B is obtained again. By repeating the steps shown in FIGS. 10A to 11B, a new sheet of recording paper S is fed.

Referring to FIGS. 8A and 8B, when small-size recording paper S1, such as a postcard, is to be used, the loading plate 11 is lifted upward, as described above with reference to FIGS. 9A and 9B, in a state where the side guides 13 are in contact with the side edges of the recording paper S1, and the exhaust process for the suction chamber 37 is performed.

In this case, when using the small-size recording paper S1, since the width of the recording paper S1 is smaller than the width between the outer skirts 36*a*, the lower sides of the outer suction chambers 37*b* are not sealed. For this reason, with the configuration in which the shutter plates 62 are not attached, even when the exhaust fan HF performs the suction process in the state where the outer suction ports 31*b* are open, outside air is continuously taken in through the outer suction ports 31*b*. Therefore, it is difficult to set the suction chamber 37 in a negative pressure state, resulting in reduced suction performance for the recording paper S1.

In contrast, in the first exemplary embodiment, when the small-size recording paper S1 is to be used, the shutter plates 62 are attached so as to close the outer suction ports 31*b*. Therefore, the exhaust process performed by the exhaust fan HF concentrates in the inner suction ports 31*a* so that the amount of exhaust per unit area, that is, suction force, increases.

In particular, in the first exemplary embodiment, the inner skirts 36*b* are disposed within the outer edges of the small-size recording paper S1 in the width direction. When the small-size recording paper S1 is to be used, even though the outer suction chambers 37*b* are not set in a sealed state, the inner suction chamber 37*a* can still be set in a sealed state. The inner skirts 36*b* may be omitted if the exhaust process concentrates in the inner suction ports 31*a* such that the suction force obtained is enough to hold the recording paper S1 by suction.

The small-size recording paper S1 is attracted to the suction head 22 by suction in a similar manner to the large-size recording paper S shown in FIGS. 10A to 11B, and is subsequently transported downstream with the movement of the suction head 22 so as to be fed to the image forming apparatus body U3.

Second Exemplary Embodiment

Although the following description relates to a feed tray according to a second exemplary embodiment of the present invention, components in the second exemplary embodiment that correspond to those in the first exemplary embodiment are given the same reference numerals, and detailed descriptions thereof will be omitted. The second exemplary embodiment differs from the first exemplary embodiment with respect to the following points, but is the same as the first exemplary embodiment with respect to other points.

Figure 12A:
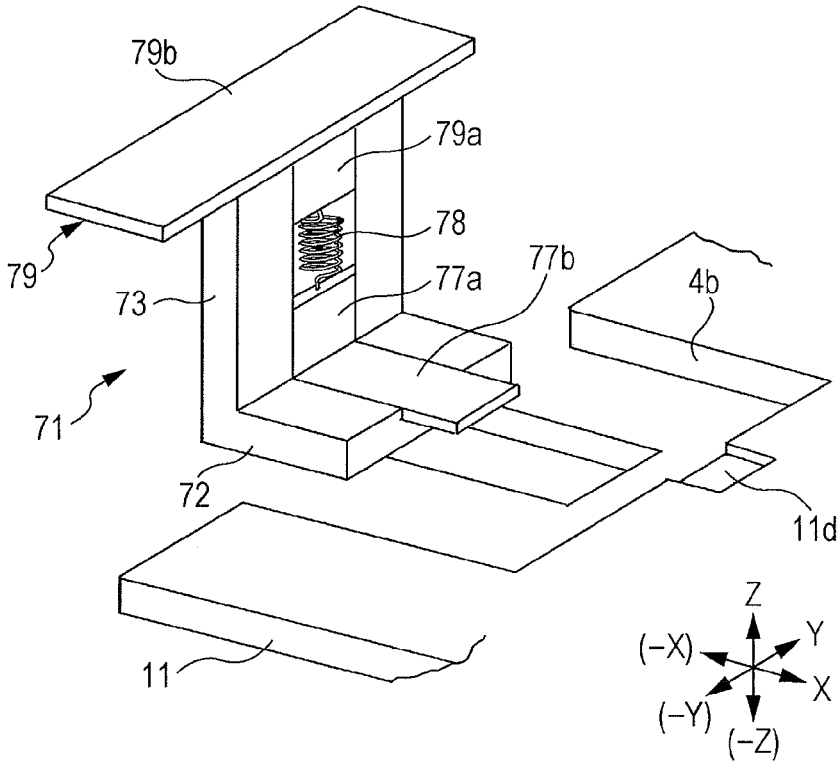
FIGS. 12A and 12B illustrate a feed tray according to a second exemplary embodiment, FIG. 12A illustrating the state of one of side guides when large-size sheets are accommodated in the feed tray, FIG. 12B illustrating the side guide when small-size sheets are accommodated in the feed tray.
Figure 12B:
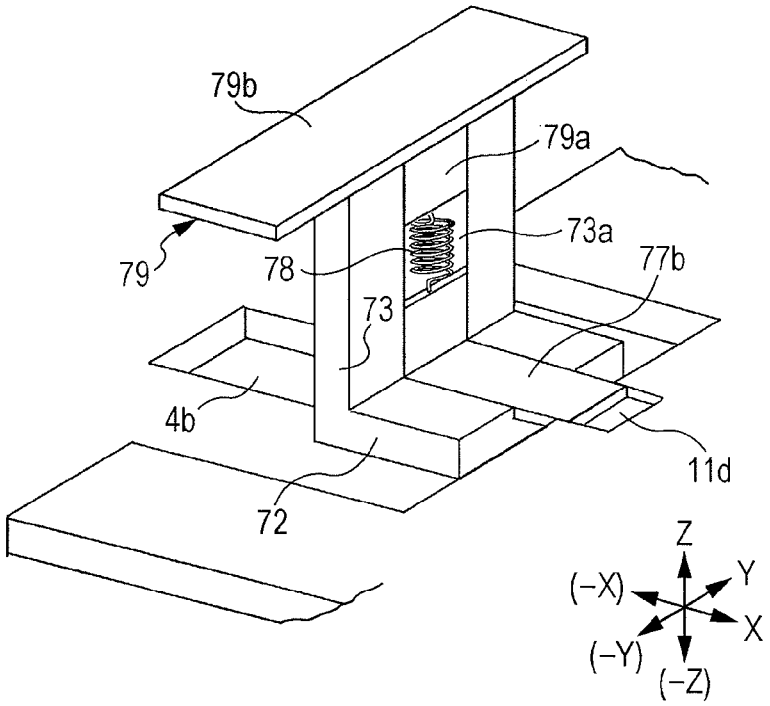

FIGS. 12A and 12B illustrate a feed tray according to the second exemplary embodiment. Specifically, FIG. 12A illustrates the state of one of side guides when large-size sheets are accommodated in the feed tray, and FIG. 12B illustrates the side guide when small-size sheets are accommodated in the feed tray.

Referring to FIGS. 12A and 12B, the feed trays TR1 and TR2 according to the second exemplary embodiment differ from those in the first exemplary embodiment in that each feed tray is not provided with the detachable shutter plates 62 but has a pair of front and rear side guides 71 with a configuration different from that in the first exemplary embodiment. With regard to the following description of the side guides 71 according to the second exemplary embodiment, since the front and rear side guides 71 have the same configuration and are simply disposed in a symmetric manner in the front-rear direction, the following description will only be directed to the rear side guide 71, and a detailed description of the front side guide 71 will be omitted.

Figure 13:
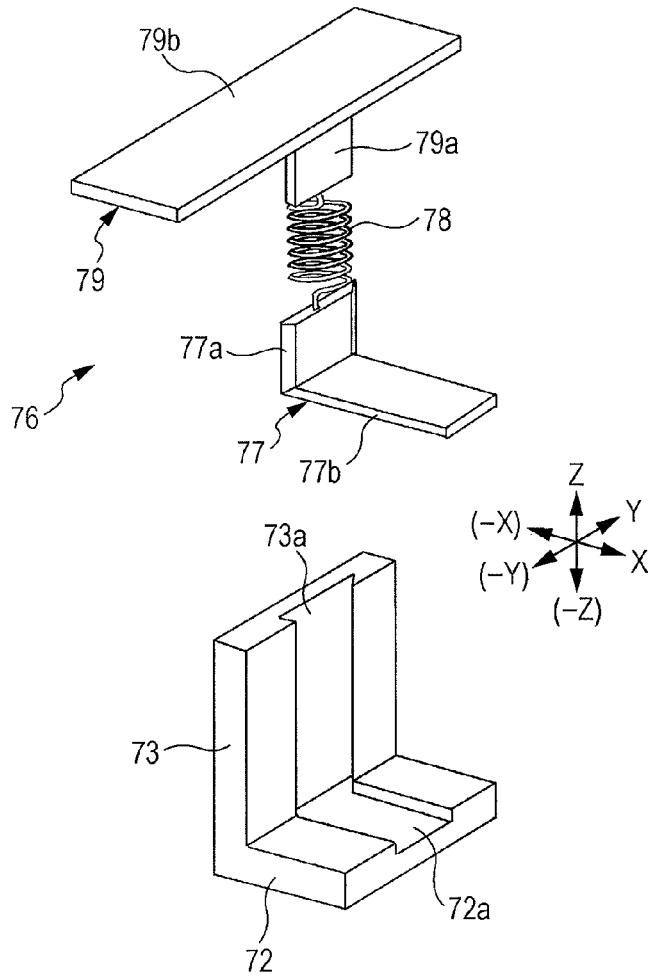
FIG. 13 is an exploded view of the side guide according to the second exemplary embodiment.

FIG. 13 is an exploded view of the side guide 71 according to the second exemplary embodiment.

Referring to FIGS. 12A to 13, the side guide 71 according to the second exemplary embodiment includes a slidable segment 72 as an example of a movable member that is disposed at the base and that is supported in a movable manner in the front-rear direction along the corresponding side guide groove 4*b*, and a side guide body 73 as an example of an alignment body extending upward from the rear edge of the slidable segment 72.

The upper surface of the slidable segment 72 is provided with an accommodation groove 72*a* as an example of an engaging-section accommodating section extending in the front-rear direction along the middle of the surface in the left-right direction.

The front surface of the side guide body 73 is provided with a shutter guide groove 73*a* as an example of a blocking guide extending in the up-down direction along the middle of the surface in the left-right direction. The lower end of the shutter guide groove 73*a* in the second exemplary embodiment is connected to the rear end of the accommodation groove 72*a*. Furthermore, the shutter guide groove 73*a* in the second exemplary embodiment has a trapezoidal shape in cross section, as viewed from above the shutter guide groove 73*a*. With regard to this trapezoidal cross-sectional shape of the shutter guide groove 73*a*, the width, in the left-right direction, of the rear side is larger than the width at the front side.

An ascendible-descendible shutter 76 as an example of a blocking member is supported by the side guide 71 in a vertically movable manner. The ascendible-descendible shutter 76 in the second exemplary embodiment has an engaging section 77 disposed at a lower portion thereof. The engaging section 77 has a plate-shaped lower guide 77*a* extending in the up-down direction and having a trapezoidal cross-sectional shape that conforms to the shape of the shutter guide groove 73*a*. The lower guide 77*a* is inserted into the shutter guide groove 73*a* from above so as to be supported in a vertically movable manner while being prevented from falling off in the forward direction owing to the engagement between the two trapezoidal structures.

The lower end of the lower guide 77*a* is provided with a plate-shaped engaging plate 77*b* as an example of an engaging body extending forward. The width, in the left-right direction, and the thickness, in the up-down direction, of the engaging plate 77*b* are set such that the engaging plate 77*b* can be accommodated within the accommodation groove 72*a*. Moreover, the length of the engaging plate 77*b* in the front-rear direction is larger than the length of the slidable segment 72.

Referring to FIGS. 12A and 12B, the length, in the front-rear direction, of the engaging plate 77*b* according to the second exemplary embodiment is set such that, when the side guide 71 is moved in accordance with the edges of an accommodated medium S having a width that is larger than or equal to a width Lb of the outer skirts 36*a* in the front-rear direction, an end, that is, the front end, of the engaging plate 77*b* does not reach the loading plate 11, but when the side guide 71 is moved in accordance with the edges of a medium S having a width that is smaller than the width Lb of the outer skirts 36*a* in the front-rear direction, the front end of the engaging plate 77*b* reaches the loading plate 11. Referring to FIG. 12A, the loading plate 11 in the second exemplary embodiment is provided with engagement recesses 11*d* at positions where the front ends of the corresponding engaging plates 77*b* reach. Each engagement recess 11*d* is an example of an engagement section engageable with the front end of the corresponding engaging plate 77*b*.

The upper end of the engaging section 77 supports a shutter body 79 as an example of a blocking member body via a spring 78 as an example of a gap adjustment member. The shutter body 79 has an upper guide 79*a* having a configuration similar to that of the lower guide 77*a* and supported in a vertically movable manner within the shutter guide groove 73*a*. The upper end of the upper guide 79*a* supports a shutter plate 79*b* as an example of a blocking section. The shutter plate 79*b* is disposed at a position corresponding to one of the outer suction chambers 37*b* when the postcard S1 is used, and is capable of closing the lower end of the outer suction chamber 37*b*. The length, in the left-right direction, of the shutter plate 79*b* in the second exemplary embodiment is set such that, in a state where the suction head 22 is moved to the suction position, the shutter plate 79*b* completely closes the lower end of the outer suction chamber 37*b* so as to set the outer suction chamber 37*b* in a closed state at least when the postcard S1 is attracted to the suction head 22 by suction, and also closes at least a portion of the lower end of the outer suction chamber 37*b* when the suction head 22 moves to the feed position so as to ensure enough suction force for preventing the postcard S1 from falling.

The engaging section 77, the spring 78, and the shutter body 79 constitute the ascendible-descendible shutter 76 as an example of a blocking member included in the blocking unit according to the second exemplary embodiment.

In each of the feed trays TR1 and TR2 according to the second exemplary embodiment having the above-described configuration, when the small-size recording paper S1 is used, the engaging plates 77*b* engage with the engagement recesses 11*d*, as shown in FIG. 12B, so that the ascendible-descendible shutters 76 and the loading plate 11 become engaged with each other. When the feeding operation commences from this state and the loading plate 11 is lifted upward, the ascendible-descendible shutters 76 ascend along the shutter guide grooves 73*a* so that the shutter plates 79*b* close the lower ends of the outer suction chambers 37*b*. Therefore, similar to the first exemplary embodiment, when the small-size recording paper S1 is used, suction through the outer suction ports 31*b* is regulated, and the recording paper S1 is attracted to the suction head 22 by suction mostly through the inner suction ports 31*a*.

In the second exemplary embodiment, the engaging sections 77 and the shutter bodies 79 are coupled to each other by the springs 78. Thus, even when the loading plate 11 ascends with the feeding operation of the recording paper S1, the springs 78 compress so as to absorb the amount of ascent. In a configuration not provided with the springs 78, there is a possibility that the loading plate 11 becomes incapable of ascending when the shutter bodies 79 come into contact with the head body 23 or that the head body 23 may break if the shutter bodies 79 press against the head body 23 with an excessive force.

Furthermore, in the second exemplary embodiment, the length of each engaging plate 77*b* is set such that the engaging plate 77*b* engages with the corresponding engagement recess 11*d* when the corresponding outer suction ports 31*b* are to be closed, but the engaging plate 77*b* does not engage with the engagement recess 11*d*, as shown in FIG. 12A, when the width of the recording paper S is larger than or equal to the width Lb of the outer skirts 36*a* and the outer suction ports 31*b* are to not be closed. Therefore, if the width of the recording paper S is larger than or equal to the width Lb of the outer skirts 36*a*, the ascendible-descendible shutters 76 do not ascend in conjunction with the ascending loading plate 11 so as to be maintained in the lowered position.

Third Exemplary Embodiment

Although the following description relates to a feed tray according to a third exemplary embodiment of the present invention, components in the third exemplary embodiment that correspond to those in the first exemplary embodiment are given the same reference numerals, and detailed descriptions thereof will be omitted. The third exemplary embodiment differs from the first exemplary embodiment with respect to the following points, but is the same as the first exemplary embodiment with respect to other points.

Figure 14:
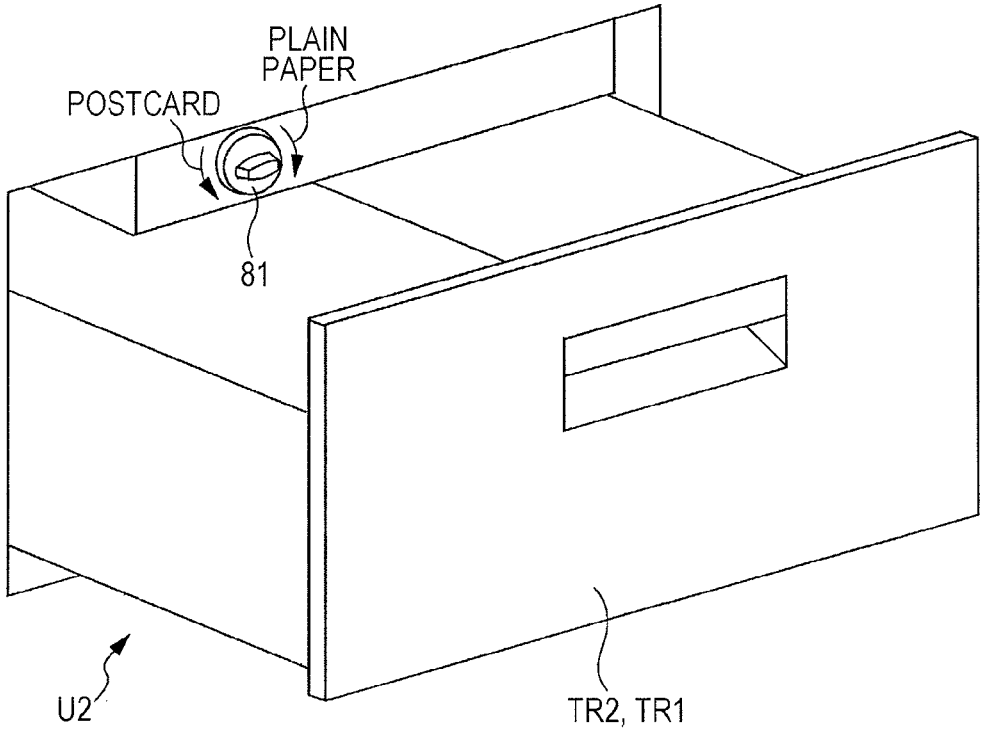
FIG. 14 illustrates a front portion of a feeding device according to a third exemplary embodiment.

FIG. 14 illustrates a front portion of a feeding device U2 according to the third exemplary embodiment.

Figure 15:
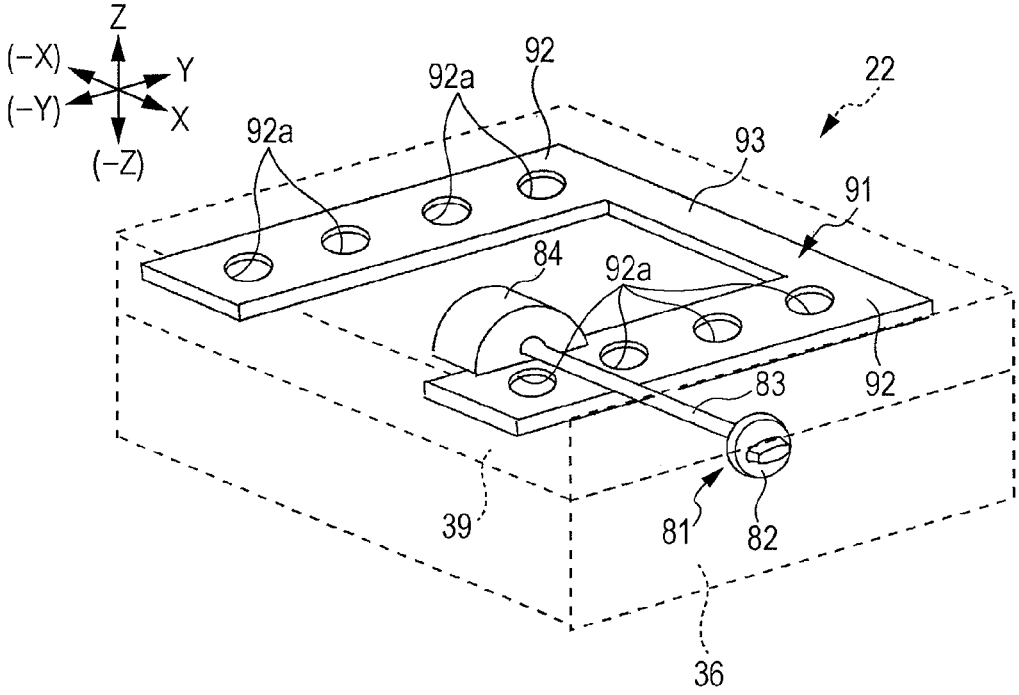
FIG. 15 illustrates a relevant part of a blocking unit according to the third exemplary embodiment.

FIG. 15 illustrates a relevant part of a blocking unit according to the third exemplary embodiment.

Figure 16A:
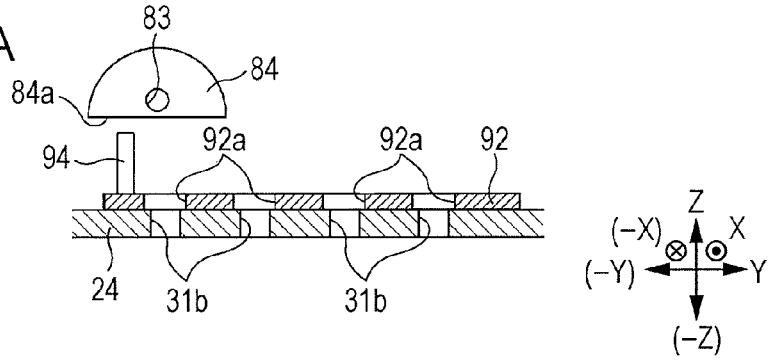
FIGS. 16A to 16D illustrate the operation of the third exemplary embodiment, FIG. 16A illustrating a state where a blocking member has moved to an opening position, FIG. 16B illustrating a state where the blocking member has moved to a closing position from the state shown in FIG. 16A, FIG. 16C illustrating a state where the blocking member starts moving toward the opening position from the state shown in FIG. 16B, FIG. 16D illustrating a state where the blocking member has moved to the opening position from the state shown in FIG. 16C.
Figure 16B:
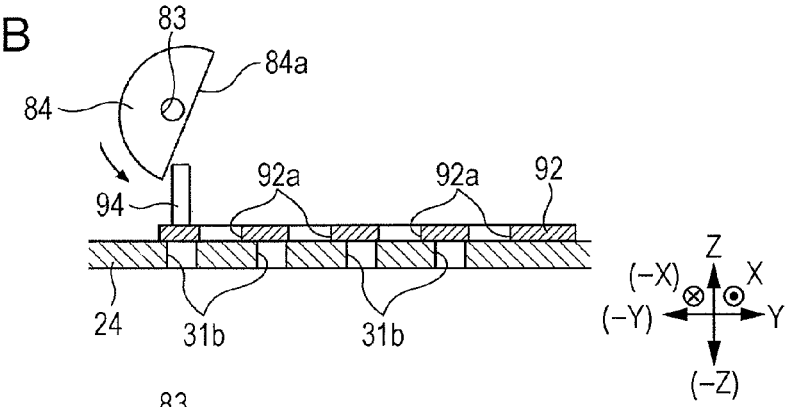
Figure 16C:
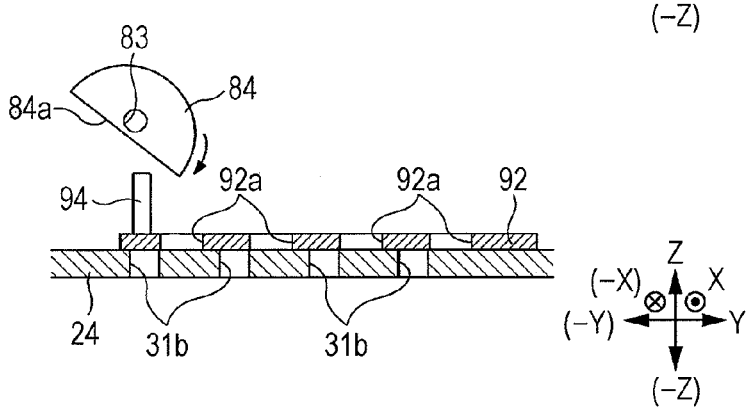
Figure 16D:
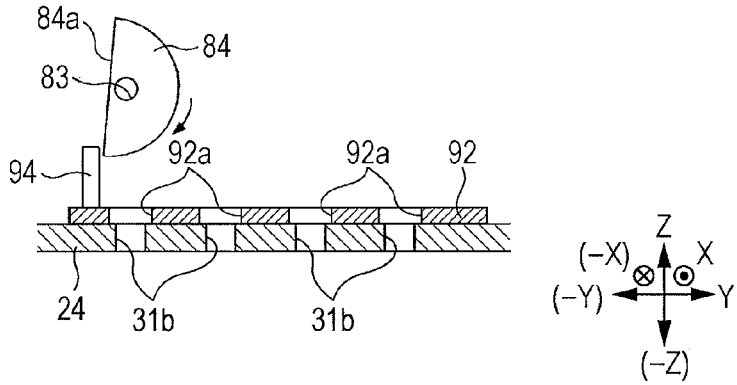

FIGS. 16A to 16D illustrate the operation of the third exemplary embodiment. Specifically, FIG. 16A illustrates a state where a blocking member has moved to an opening position, FIG. 16B illustrates a state where the blocking member has moved to a closing position from the state shown in FIG. 16A, FIG. 16C illustrates a state where the blocking member starts moving toward the opening position from the state shown in FIG. 16B, and FIG. 16D illustrates a state where the blocking member has moved to the opening position from the state shown in FIG. 16C.

The feeding device U2 according to the third exemplary embodiment differs from that in the first exemplary embodiment in not being provided with the detachable shutter plates 62 and the corresponding configuration. Referring to FIG. 14, in the feeding device U2 according to the third exemplary embodiment, a shutter-opening-closing knob 81 as an example of a blocking movable member is supported by the front surface of the feeding device U2 at a position corresponding to the front surface of the sheet fetching unit 21. Referring to FIG. 15, the shutter-opening-closing knob 81 includes an operable section 82, and a shaft section 83 extending rearward from the operable section 82. Referring to FIGS. 15 to 16D, the rear end of the shaft section 83 supports a semicircular cam section 84 as an example of an engaging section. The cam section 84 has a flat lower surface 84*a*.

The shaft section 83 supports a torsion spring (not shown) as an example of a restoring member that applies a rotational force to the knob 81 in a restoring direction so that even when the knob 81 rotates, the knob 81 is set back to its initial position in which the lower surface 84*a* of the cam section 84 faces downward. Specifically, when the operator manually operates the operable section 82 to rotate the knob 81, the torsion spring (not shown) elastically deforms so as to apply an elastic restoring force for rotating the knob 81 toward the initial position. When the operator releases his/her hand from the operable section 82, the elastic restoring force sets the knob 81 back to its initial position.

Referring to FIGS. 15 to 16D, a shutter plate 91 as an example of a blocking member included in the blocking unit is supported by the upper surface of the base plate 24 in a movable manner in the left-right direction. The shutter plate 91 has a pair of front and rear shutter segments 92 that are disposed in correspondence with the front and rear outer suction ports 31*b*. The shutter segments 92 are connected to each other by a connecting segment 93 extending in the front-rear direction at the right end of the shutter plate 91.

The shutter segments 92 are each provided with vent holes 92*a* that correspond to the outer suction ports 31*b* and that are spaced apart from each other in the left-right direction. Therefore, as shown in FIGS. 16A and 16D, when the vent holes 92*a* move to positions above the outer suction ports 31*b*, the outer suction ports 31*b* become open so that the gas in the suction chamber 37 may be suctioned through the outer suction ports 31*b*. Furthermore, as shown in FIGS. 16B and 16C, when the vent holes 92*a* are positionally displaced from the outer suction ports 31*b*, the shutter segments 92 close the outer suction ports 31*b* so as to block the suction of gas from the suction chamber 37 through the outer suction ports 31*b*.

Referring to FIGS. 15 to 16D, the left end of the front shutter segment 92 supports an engagement lever 94 as an example of an engagement section that extends upward at a position corresponding to the cam section 84. The engagement lever 94 extends upward through a long hole (not shown) extending in the left-right direction in the upper plate 39*a* of the cover 39. The length of the engagement lever 94 is set such that the terminal end of the engagement lever 94 is disposed proximate to the lower surface 84*a* of the cam section 84 in a non-contact state when the cam section 84 is in the initial position. The long hole (not shown) supports a seal member (not shown) composed of an elastic material so as to substantially prevent entry of outside air through areas of the long hole (not shown) excluding an area thereof through which the engagement lever 94 passes. In other words, the seal member in the long hole (not shown) ensures a sealed state to an extent that the suction performance for the recording paper S is not adversely affected.

Therefore, with regard to the shutter plate 91 in the third exemplary embodiment, when the knob 81 is rotated in the counterclockwise direction as an example of a first direction, the cam section 84 rotates from the state shown in FIG. 16A to the state shown in FIG. 16B so that the lower surface 84*a* of the cam section 84 pushes the engagement lever 94 rightward, whereby the shutter plate 91 moves from the opening position shown in FIG. 16A to the closing position shown in FIG. 16B. In this state, the outer suction ports 31*b* are closed. In the third exemplary embodiment, a stopper (not shown) is provided and set so as to prevent the knob 81 from rotating further in the counterclockwise direction from the state shown in FIG. 16B.

When the operator releases his/her hand from the operable section 82 of the knob 81, the cam section 84 returns to the initial position shown in FIG. 16A due to the elastic force of the torsion spring (not shown) while the shutter plate 91 is maintained at the closing position shown in FIG. 16B.

Referring to FIGS. 16C and 16D, when the knob 81 is rotated in the clockwise direction as an example of a second direction, the cam section 84 rotates from its initial position so that the lower surface 84*a* of the cam section 84 pushes the engagement lever 94 leftward, as shown in FIGS. 16C and 16D, whereby the shutter plate 91 moves from the closing position shown in FIG. 16C to the opening position shown in FIG. 16D. In this state, the outer suction ports 31*b* are open. In the third exemplary embodiment, a stopper (not shown) is provided and set so as to prevent the knob 81 from rotating further in the clockwise direction from the state shown in FIG. 16D.

When the operator releases his/her hand from the operable section 82 of the knob 81, the cam section 84 returns to the initial position shown in FIG. 16A due to the elastic force of the torsion spring (not shown) while the shutter plate 91 is maintained at the opening position shown in FIGS. 16A and 16D.

In the feeding device U2 according to the third exemplary embodiment having the above-described configuration, when the knob 81 is rotated, the shutter plate 91 moves between the opening position and the closing position. Therefore, in a case where the small-size recording paper S1 is used, when the knob 81 is rotated counterclockwise, the outer suction ports 31*b* become closed so that the recording paper S1 is attracted to the suction head 22 by suction mostly through the inner suction ports 31*a*, as in the first and second exemplary embodiments.

In the third exemplary embodiment, the torsion spring (not shown) returns the knob 81 to its initial position, and the front surface of the knob 81 is covered by the front surface of the feed tray TR1 or TR2 when the feed tray TR1 or TR2 is loaded in the feeding device U2. Therefore, the operator is not capable of touching the knob 81, whereby the cam section 84 returned to its initial position is maintained at a position distant from the engagement lever 94. Consequently, when the feeding operation commences and the suction head 22 moves in the left-right direction, the cam section 84 is prevented from coming into contact with the engagement lever 94, thereby reducing movement of the shutter plate 91.

In a case where large-size recording paper S is used, when the knob 81 is rotated clockwise, the outer suction ports 31*b* become open so that the recording paper S is attracted to the suction head 22 by suction using both the inner suction ports 31*a* and the outer suction ports 31*b*.

Fourth Exemplary Embodiment

Although the following description relates to a feed tray according to a fourth exemplary embodiment of the present invention, components in the fourth exemplary embodiment that correspond to those in the first to third exemplary embodiments are given the same reference numerals, and detailed descriptions thereof will be omitted. The fourth exemplary embodiment differs from the first to third exemplary embodiments with respect to the following points, but is the same as the first to third exemplary embodiments with respect to other points.

Figure 17:
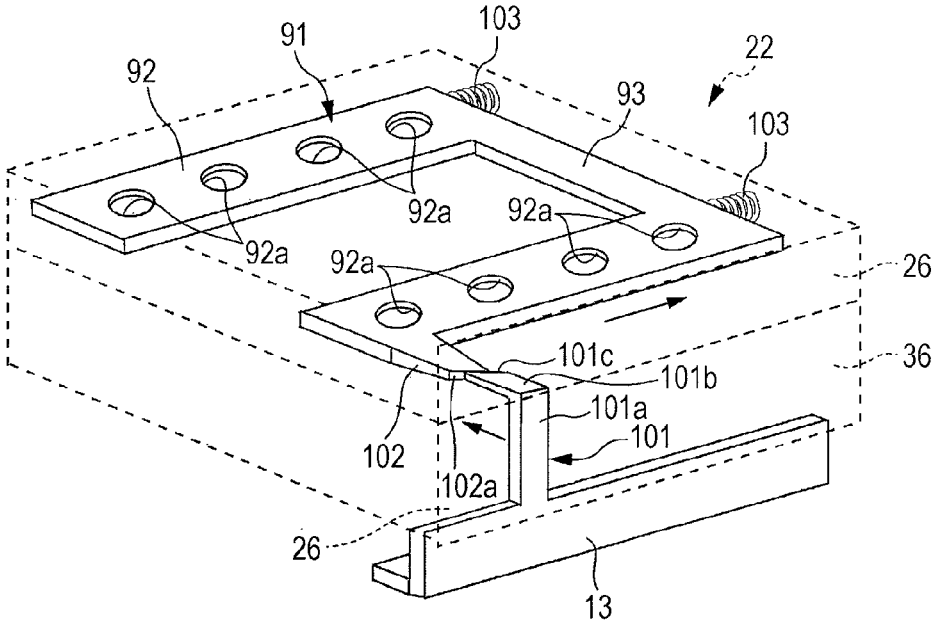
FIG. 17 illustrates a relevant part of a blocking unit according to a fourth exemplary embodiment.

FIG. 17 illustrates a relevant part of a blocking unit according to the fourth exemplary embodiment.

A feeding device U2 according to the fourth exemplary embodiment differs from that in the first exemplary embodiment in not being provided with the detachable shutter plates 62 and the corresponding configuration. Referring to FIG. 17, in the feeding device U2 according to the fourth exemplary embodiment, a shutter actuating member 101 as an example of an engaging section is supported by the upper edge of the front side guide 13. The shutter actuating member 101 includes an extension segment 101*a* extending upward from the upper edge of the side guide 13 to a position higher than the base plate 24, an actuating body 101*b* extending rearward from the upper end of the extension segment 101*a*, and an engaging surface 101*c* that is formed at the rear end of the actuating body 101*b* and that is inclined leftward toward the rear side.

Referring to FIG. 17, in place of the engagement lever 94 in the shutter plate 91 according to the third exemplary embodiment, the blocking unit according to the fourth exemplary embodiment has an engagement plate 102 as an example of an engagement section extending forward from the left edge of the front shutter segment 92. The engagement plate 102 is disposed at a position corresponding to the shutter actuating member 101. The front end of the engagement plate 102 is provided with an engagement surface 102*a* that faces the engaging surface 101*c* and that is inclined rightward toward the front side.

In the fourth exemplary embodiment, the lengths of the actuating body 101*b* and the engagement plate 102 in the front-rear direction are set such that, when the side guides 13 come into contact with the widthwise edges of the small-size recording paper S1 having a width smaller than the width Lb, the engaging surface 101*c* and the engagement surface 102*a* come into contact with each other so that the shutter plate 91 moves to the closing position at the right side, and when the side guides 13 come into contact with the widthwise edges of the large-size recording paper S having a width larger than or equal to the width Lb, the engaging surface 101*c* and the engagement surface 102*a* move away from each other.

Furthermore, in the fourth exemplary embodiment, springs 103 as an example of biasing members that always bias the shutter plate 91 leftward are supported between the right edge of the shutter plate 91 and the inner surface of the right sidewall 29.

In the fourth exemplary embodiment, the front sidewall 26 through which the engagement plate 102 passes supports a seal member (not shown), as in the third exemplary embodiment.

Therefore, in the fourth exemplary embodiment, when the large-size recording paper S is accommodated in the feed tray TR1 or TR2 and the side guides 13 have moved outward in the front-rear direction, the actuating body 101*b* and the engagement plate 102 are positioned distant from each other even when the feed tray TR1 or TR2 in an ejected state is inserted into the feeding device U2, whereby the shutter plate 91 moves to the opening position at the left side by being pushed by the springs 103.

When the small-size recording paper S1 is accommodated in the feed tray TR1 or TR2 and the side guides 13 have moved inward in the front-rear direction, the engaging surface 101*c* and the engagement surface 102*a* come into contact with each other as the feed tray TR1 or TR2 is inserted into the feeding device U2, whereby the engagement surface 102*a* is pushed rightward. Consequently, the shutter plate 91 moves from the opening position to the closing position at the right side against the elastic force of the springs 103.

In the feeding device U2 according to the fourth exemplary embodiment having the above-described configuration, when the side guides 13 move in accordance with the width of the recording paper S accommodated in the feed tray TR1 or TR2, the shutter actuating member 101 moves in conjunction with the side guides 13. If the accommodated recording paper S is of a large-size type, the shutter actuating member 101 does not engage with the engagement plate 102 so that the shutter plate 91 is maintained in the opening position, whereby the recording paper S is attracted to the suction head 22 by suction through the outer suction ports 31*b*.

If the accommodated recording paper S1 is of a small-size type, the shutter actuating member 101 engages with the engagement plate 102 so as to move the shutter plate 91 to the closing position. Therefore, when attracting the recording paper S to the suction head 22 by suction, the outer suction ports 31*b* are in a closed state so that the recording paper S1 is attracted to the suction head 22 by suction mostly through the inner suction ports 31*a*.

In the fourth exemplary embodiment, in the case where the small-size recording paper S1 is used, the outer suction ports 31*b* are closed when the suction head 22 is moved to the suction position at the left side where suction is performed. As the suction head 22 moves rightward toward the feed position, the shutter actuating member 101 and the engagement plate 102 become disengaged from each other, causing the shutter plate 91 to relatively move toward the opening position. At the suction position corresponding to a maximum suction force, it may be desirable that the suction be performed in a state where the outer suction ports 31*b* are closed. However, in a state where the recording paper S1 is attracted to the suction head 22 by suction and the seal skirt 36 is moved to the upper end, the suctioned state of the recording paper S1 may still be maintained with a low suction force, as compared with a case where the recording paper S1 is attracted to the suction head 22 by suction from above the loading plate 11. Therefore, in the fourth exemplary embodiment, the outer suction ports 31*b* are closed at least at the suction position so that the suction performance for the small-size recording paper S1 may be improved. It may be desirable that the closed state be maintained as much as possible so that a sufficient suction force is maintained until the small-size recording paper S1 attracted to the suction head 22 by suction is transferred to the transport rollers Ra located downstream thereof. For example, the widths of the shutter actuating member 101 and the engagement plate 102 in the left-right direction and the inclination angles of the surfaces 101*c* and 102*a* may be set such that the outer suction ports 31*b* are completely opened after the leading edge of the recording paper S1 in the transport direction reaches the transport rollers Ra.

Fifth Exemplary Embodiment

Although the following description relates to a feed tray according to a fifth exemplary embodiment of the present invention, components in the fifth exemplary embodiment that correspond to those in the first to fourth exemplary embodiments are given the same reference numerals, and detailed descriptions thereof will be omitted. The fifth exemplary embodiment differs from the first to fourth exemplary embodiments with respect to the following points, but is the same as the first to fourth exemplary embodiments with respect to other points.

Figure 18:
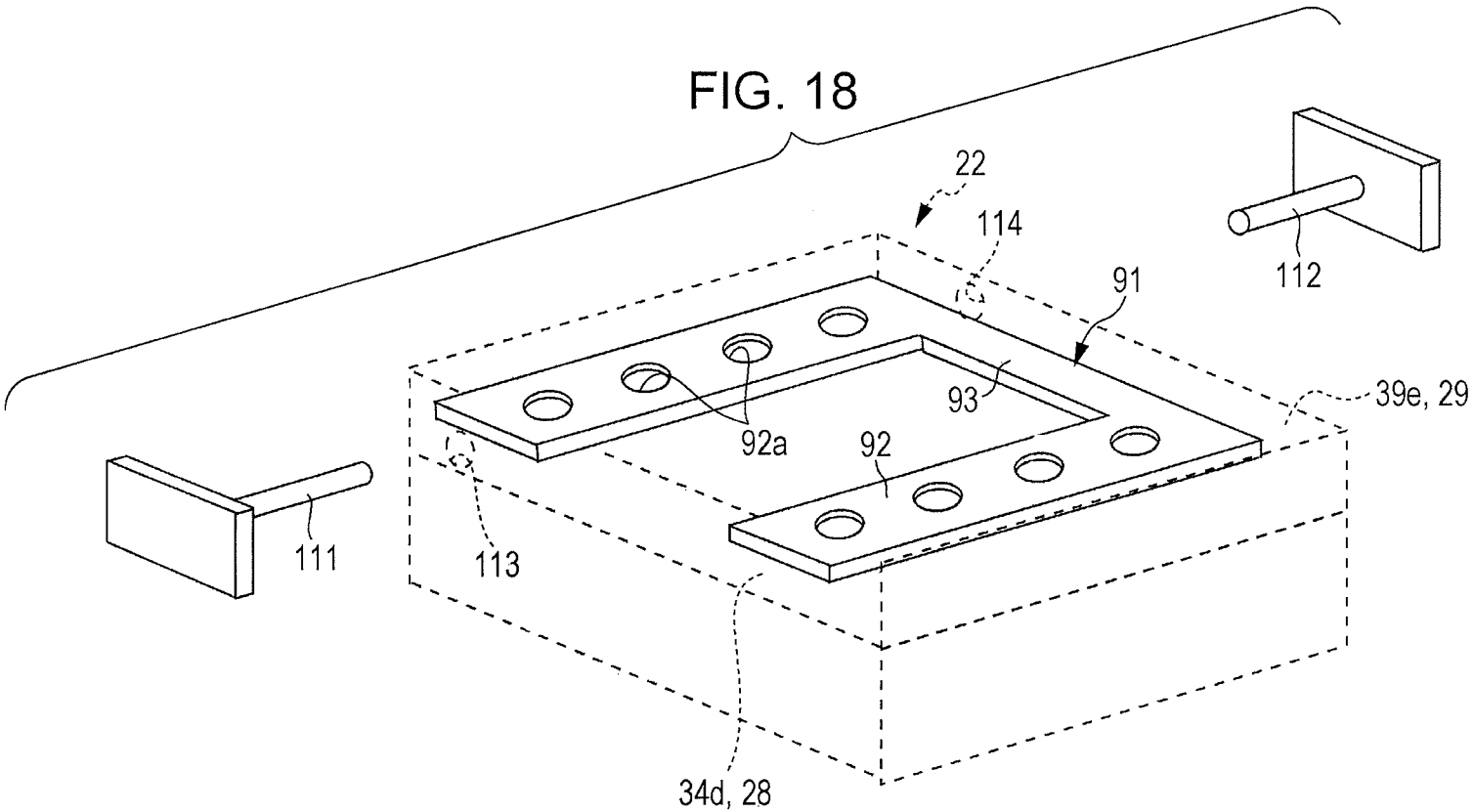
FIG. 18 illustrates a relevant part of a blocking unit according to a fifth exemplary embodiment.

FIG. 18 illustrates a relevant part of a blocking unit according to the fifth exemplary embodiment.

Figure 19A:
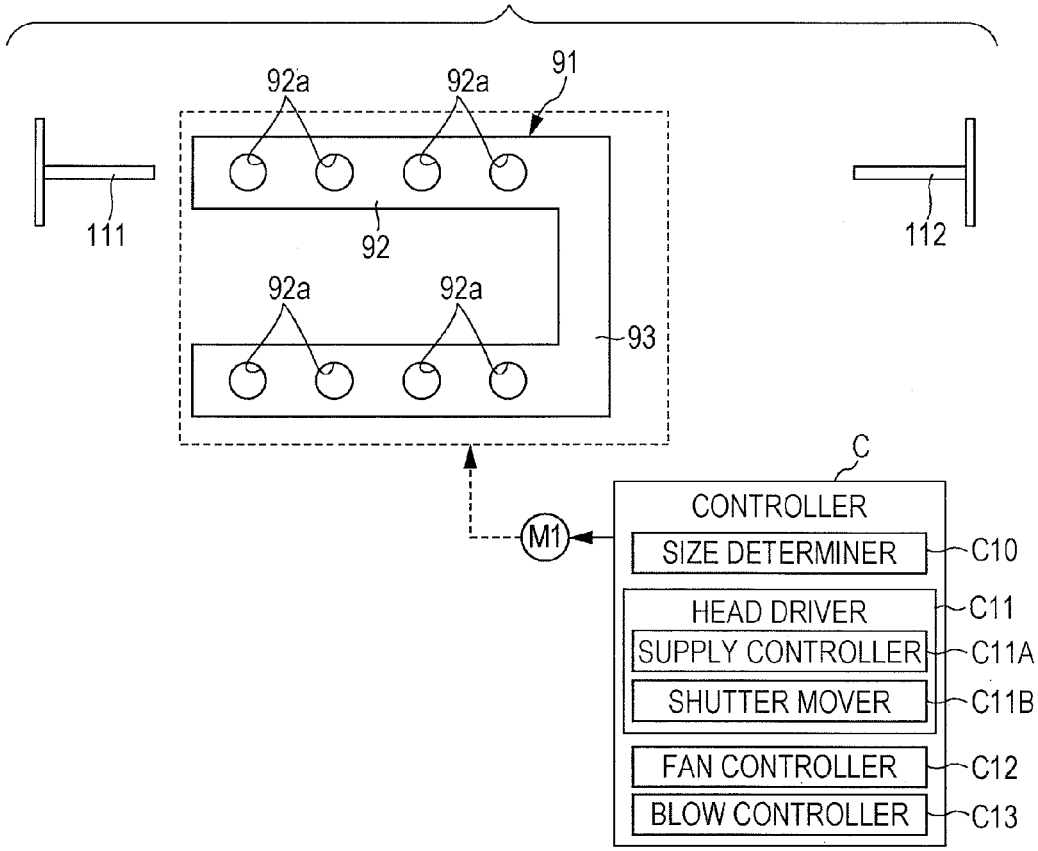
FIGS. 19A and 19B illustrate the operation of the blocking unit according to the fifth exemplary embodiment, FIG. 19A illustrating a state where the suction head is moved to the suction position and a shutter plate is moved to an opening position, FIG. 19B illustrating a state where the suction head is moved to a feed position from the state shown in FIG. 19A.
Figure 19B:
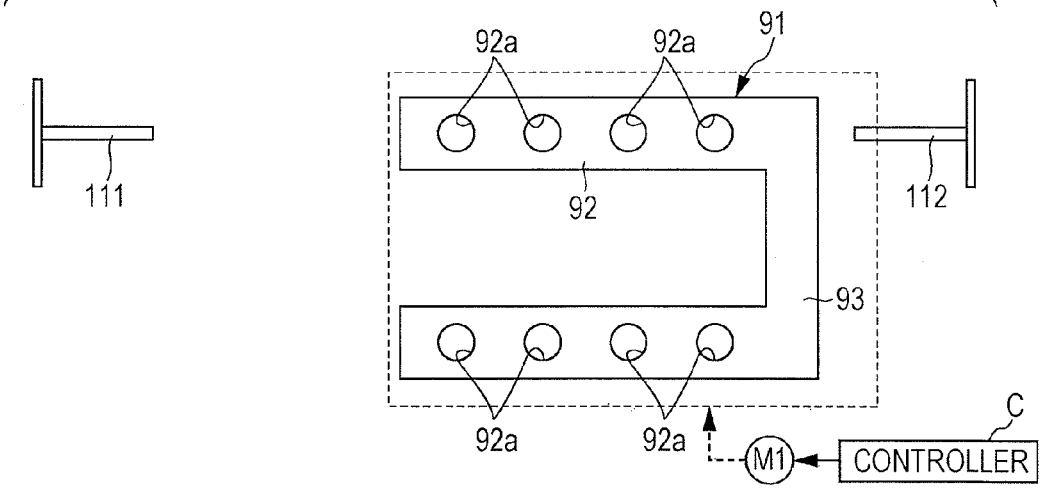

FIGS. 19A and 19B illustrate the operation of the blocking unit according to the fifth exemplary embodiment. Specifically, FIG. 19A illustrates a state where the suction head 22 is moved to the suction position and the shutter plate 91 is moved to the opening position, and FIG. 19B illustrates a state where the suction head 22 is moved to the feed position from the state shown in FIG. 19A.

Figure 20A:
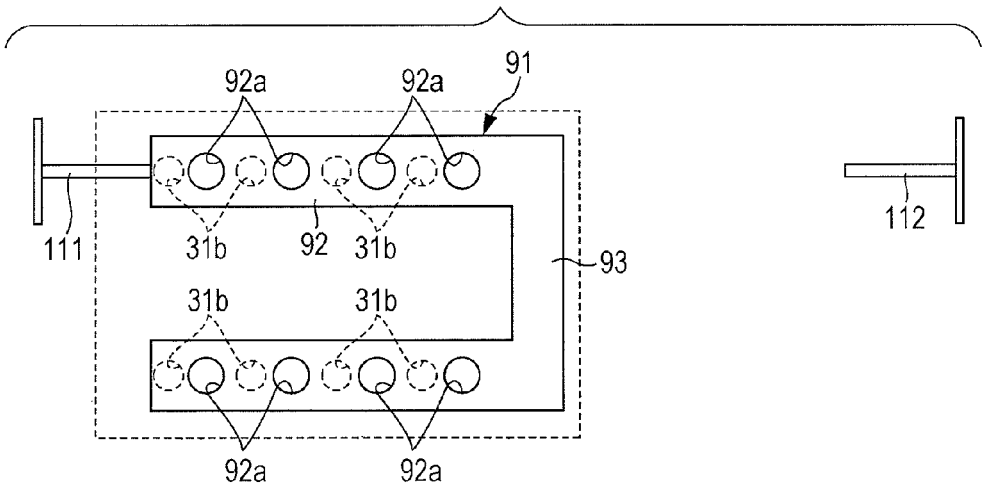
FIGS. 20A and 20B illustrate the operation of the fifth exemplary embodiment, FIG. 20A illustrating a state where the suction head is moved to a closing actuation position and the shutter plate is moved to a closing position, FIG. 20B illustrating a state where the suction head is moved to the suction position from the state shown in FIG. 20A.
Figure 20B:
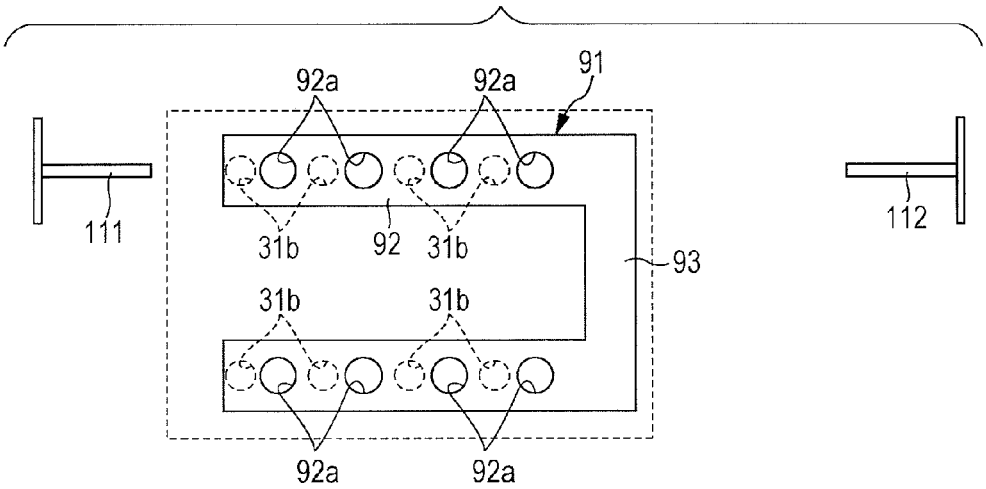

FIGS. 20A and 20B illustrate the operation of the fifth exemplary embodiment. Specifically, FIG. 20A illustrates a state where the suction head 22 is moved to a closing actuation position and the shutter plate 91 is moved to the closing position, and FIG. 20B illustrates a state where the suction head 22 is moved to the suction position from the state shown in FIG. 20A.

Figure 21A:
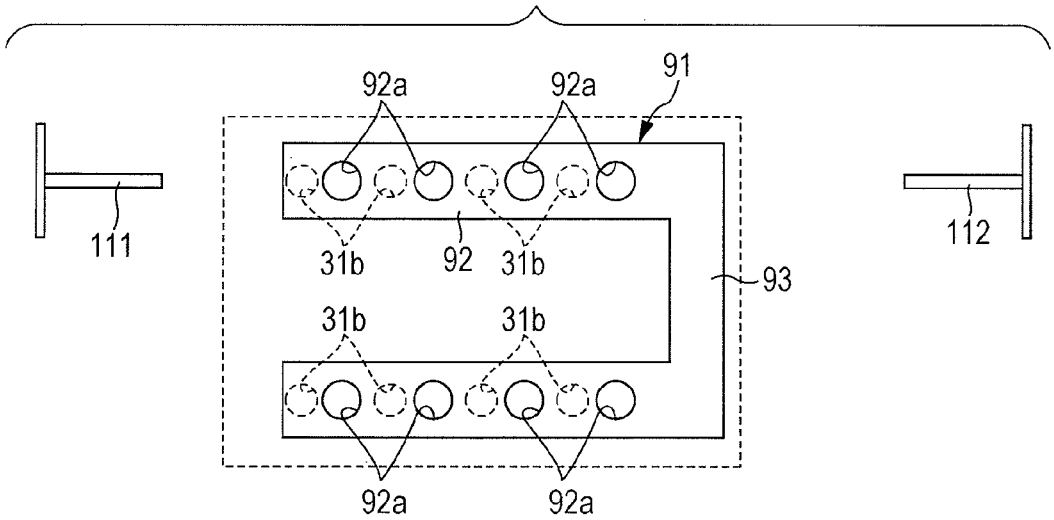
FIGS. 21A and 21B illustrate the operation of the fifth exemplary embodiment, FIG. 21A illustrating a state where the suction head is moved to the feed position from the state shown in FIG. 20B, FIG. 21B illustrating a state where the suction head is moved to an opening actuation position from the state shown in FIG. 21A and the shutter plate is moved to the opening position.
Figure 21B:
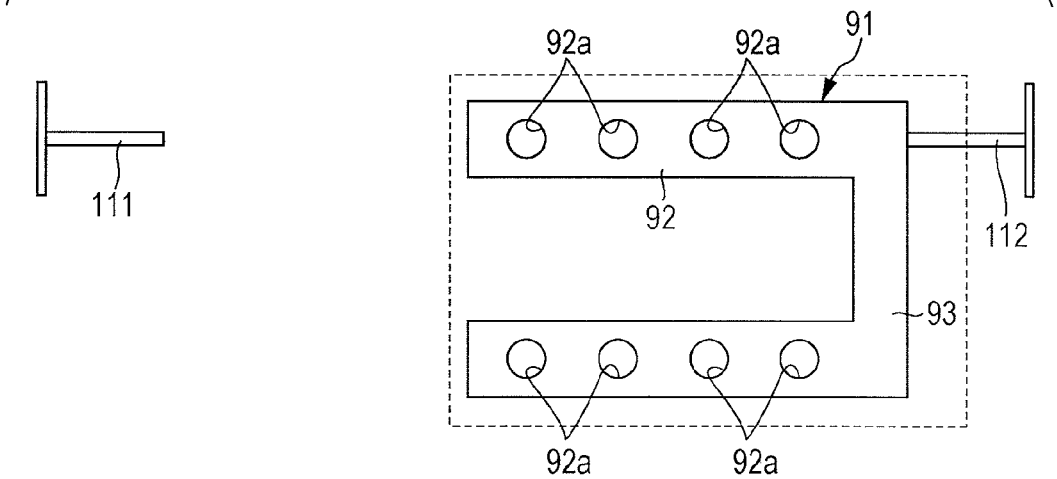

FIGS. 21A and 21B illustrate the operation of the fifth exemplary embodiment. Specifically, FIG. 21A illustrates a state where the suction head 22 is moved to the feed position from the state shown in FIG. 20B, and FIG. 21B illustrates a state where the suction head 22 is moved to an opening actuation position from the state shown in FIG. 21A and the shutter plate 91 is moved to the opening position.

In a feeding device U2 according to the fifth exemplary embodiment, the engagement plate 102 and the springs 103 have been omitted from the shutter plate 91 according to the fourth exemplary embodiment. Furthermore, in the feeding device U2 according to the fifth exemplary embodiment, a closing-position-shifting protrusion 111 as an example of a first engaging member is disposed to the left of the suction head 22 and protrudes rightward so as to be is supported by the feeding device U2. Moreover, an opening-position-shifting protrusion 112 as an example of a second engaging member protruding leftward is supported at the right side of the suction head 22. In the fifth exemplary embodiment, the closing-position-shifting protrusion 111 is disposed such that the terminal end thereof is positioned to the left of the left end of the suction head 22 when in the suction position, and the opening-position-shifting protrusion 112 is disposed such that the terminal end thereof is positioned to the right of the right end of the suction head 22 when in the feed position.

Referring to FIG. 18, the left sidewall 28 of the head body 23 and the left side plate 39*d* of the cover 39 are provided with a left through-hole 113 disposed at a position corresponding to the closing-position-shifting protrusion 111 and through which the closing-position-shifting protrusion 111 can pass. Likewise, the right sidewall 29 of the head body 23 and the right side plate 39*e* of the cover 39 are provided with a right through-hole 114 disposed at a position corresponding to the opening-position-shifting protrusion 112 and through which the opening-position-shifting protrusion 112 can pass. The through-holes 113 and 114 formed in the sidewalls 28 and 29 support seal members for reducing the amount of gas flowing therethrough. For example, the seal members used here may each be formed of a rubber disk having slits extending radially from the center thereof. The seal members elastically deform when the protrusions 111 and 112 are inserted into the through-holes 113 and 114 and elastically restore their original state when the protrusions 111 and 112 are removed from the through-holes 113 and 114.

Referring to FIGS. 19A to 21B, in the fifth exemplary embodiment, the suction head 22 is supported in a movable manner between the suction position shown in FIGS. 19A and 20B, the feed position shown in FIG. 21A, the closing actuation position shown in FIG. 20A that is set upstream of the suction position in the transport direction, and the opening actuation position shown in FIG. 21B that is set downstream of the feed position in the transport direction.

As shown in FIG. 20A, the closing actuation position in the fifth exemplary embodiment is set at a position corresponding to where the closing-position-shifting protrusion 111 passes through the left through-hole 113 and comes into contact with a left end surface of the shutter plate 91 so as to move the shutter plate 91 to the closing position at the right side. As shown in FIG. 21B, the opening actuation position in the fifth exemplary embodiment is set at a position corresponding to where the opening-position-shifting protrusion 112 passes through the right through-hole 114 and comes into contact with a right end surface of the shutter plate 91 so as to move the shutter plate 91 to the opening position at the left side.

Referring to FIGS. 19A and 19B, in addition to the fan controller C12 and the blow controller C13 in the first exemplary embodiment, the feed controller Cl in the fifth exemplary embodiment includes a size determiner C10 as an example of a medium-type determiner, and a head driver C11 as an example of a transport controller different from that in the first exemplary embodiment.

The size determiner C10 determines whether or not the size of the recording paper S accommodated in each of the feed trays TR1 and TR2 is smaller than a predetermined size on the basis of an input from the user interface UI. For example, in the fifth exemplary embodiment, the size determiner C10 determines whether or not the recording paper S has a width that is smaller than the width Lb. In other words, the size determiner C10 determines whether or not the recording paper S is a postcard. The reference used for determining the size is not limited to a postcard size. For example, based on A5-size paper as a reference, the size determiner C10 may determine whether or not the recording paper S is smaller than or equal to A5-size paper, or larger than A5-size paper.

The head driver C11 includes a supply controller C11A having the same configuration as that in the first exemplary embodiment, and a shutter mover C11B as an example of a blocking controller. The head driver C11 controls the forward and reverse rotation of the motor M1 so as to drive the suction head 22 and control the position thereof.

The shutter mover C11B rotates the motor M1 in the forward or reverse direction on the basis of the type of recording paper S determined by the size determiner C10 so as to move the suction head 22 between the opening actuation position and the closing actuation position. If the recording paper S is of a small-size type, the shutter mover C11B in the fifth exemplary embodiment rotates the motor M1 in the reverse direction for a predetermined closing time period t1 before the feeding operation commences so as to move the suction head 22 from the suction position to the closing actuation position, thereby moving the shutter plate 91 to the closing position. Subsequently, the shutter mover C11B rotates the motor M1 in the forward direction for the closing time period t1 so as to return the suction head 22 to the suction position.

If the recording paper S is of a large-size type, the shutter mover C11B according to the fifth exemplary embodiment rotates the motor M1 in the forward direction for a predetermined opening time period t2 before the feeding operation commences so as to move the suction head 22 from the suction position to the opening actuation position, thereby moving the shutter plate 91 to the opening position. Subsequently, the shutter mover C11B rotates the motor M1 in the reverse direction for the opening time period t2 so as to return the suction head 22 to the suction position. The closing time period t1 and the opening time period t2 are set to time periods within which the suction head 22 can reach the closing actuation position and the opening actuation position, respectively, and are preliminarily measured and determined from tests, but are not limited to such time periods. For example, sensors serving as detecting members that detect the suction head 22 may be disposed at the closing actuation position and the opening actuation position, such that the suction head 22 may be stopped on the basis of detection results obtained by the sensors.

In the feeding device U2 according to the fifth exemplary embodiment having the above-described configuration, the suction head 22 is moved to the closing actuation position or the opening actuation position in accordance with the size of the recording paper S prior to the feeding operation so as to open or close the outer suction ports 31*b*. Then, after the outer suction ports 31*b* are opened or closed, the recording paper S is attracted to the suction head 22 by suction and is transported downstream. Therefore, in the case where the small-size recording paper S1 is used, the outer suction ports 31*b* are closed so that the recording paper S1 is attracted to the suction head 22 by suction mostly through the inner suction ports 31*a*.

Sixth Exemplary Embodiment

Although the following description relates to a feed tray according to a sixth exemplary embodiment of the present invention, components in the sixth exemplary embodiment that correspond to those in the first to fifth exemplary embodiments are given the same reference numerals, and detailed descriptions thereof will be omitted. The sixth exemplary embodiment differs from the first to fifth exemplary embodiments with respect to the following points, but is the same as the first to fifth exemplary embodiments with respect to other points.

Figure 22:
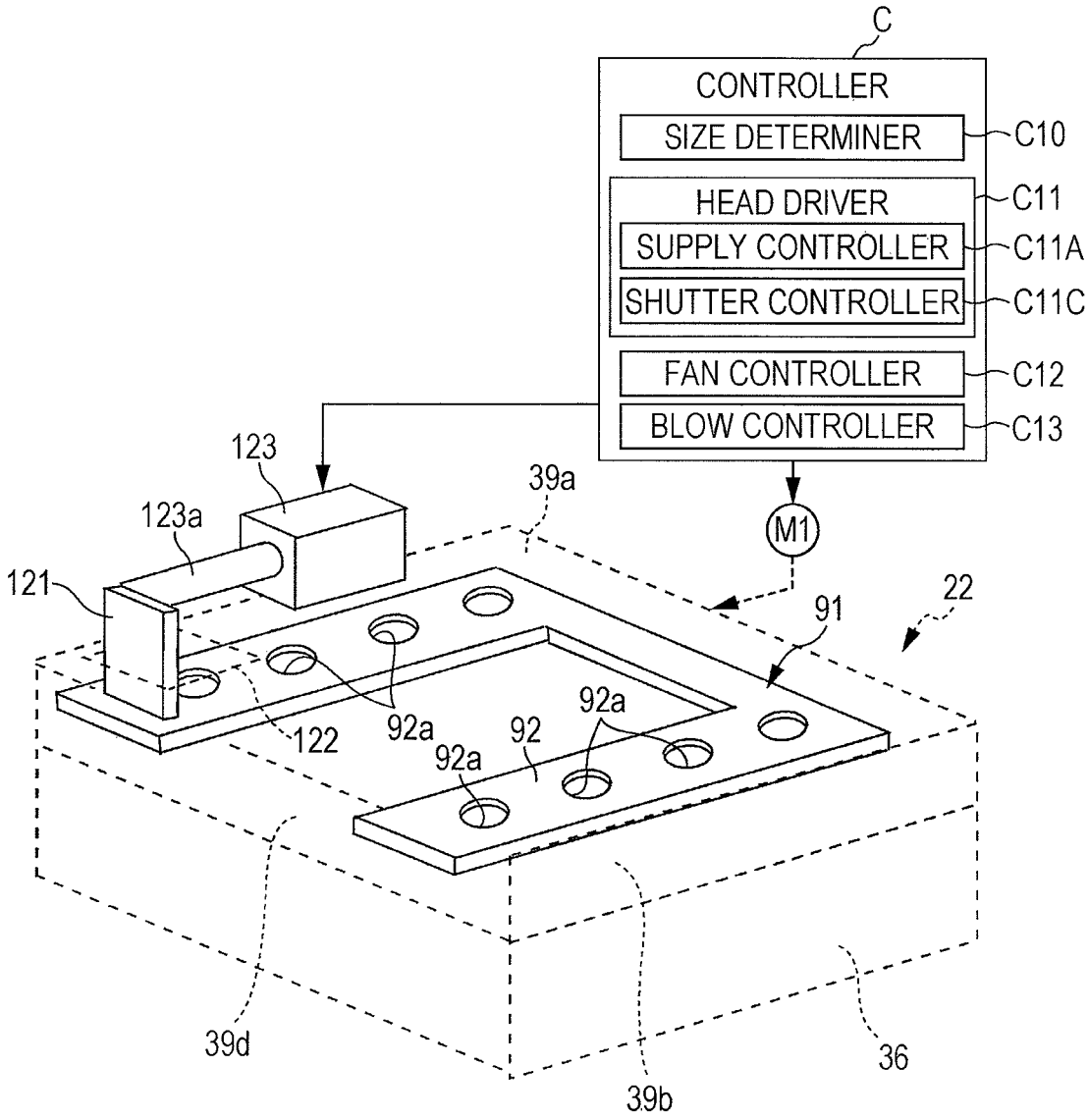
FIG. 22 illustrates a relevant part of a blocking unit according to a sixth exemplary embodiment.

FIG. 22 illustrates a relevant part of a blocking unit according to the sixth exemplary embodiment.

In a feeding device U2 according to the sixth exemplary embodiment, the engagement plate 102 and the springs 103 have been omitted from the shutter plate 91 according to the fourth exemplary embodiment. In the feeding device U2 according to the sixth exemplary embodiment, a connecting member 121 as an example of an engaging section extending upward is supported by the left end of the rear shutter segment 92 of the shutter plate 91. The connecting member 121 extends upward through a long hole 122 extending in the left-right direction in the upper plate 39*a* of the cover 39. The long hole 122 supports a seal member (not shown), as in the third exemplary embodiment, so that a sealed state is ensured.

The upper surface of the upper plate 39*a* of the cover 39 supports a keep solenoid 123 as an example of a blocking actuation member at a position corresponding to the right side of the connecting member 121. The keep solenoid 123 has a plunger 123*a* as an example of a movable section. An end of the plunger 123*a* is connected to the upper end of the connecting member 121.

When the keep solenoid 123 is actuated, the plunger 123*a* expands or contracts so as to move the shutter plate 91 to the opening position or the closing position via the connecting member 121.

Referring to FIG. 22, the feed controller Cl in the sixth exemplary embodiment includes a shutter controller C11C that is different from the shutter mover C11B in the fifth exemplary embodiment.

The shutter controller C11C in the sixth exemplary embodiment actuates the keep solenoid 123 on the basis of the type of recording paper S determined by the size determiner C10 so as to move the shutter plate 91 to the opening position or the closing position. If the recording paper S is of a small-size type, the shutter controller C11C in the sixth exemplary embodiment actuates the keep solenoid 123 before the feeding operation commences so as to expand the plunger 123*a*, whereby the shutter plate 91 moves to the closing position and is maintained at the closing position by the keep solenoid 123. If the recording paper S is of a large-size type, the shutter controller C11C actuates the keep solenoid 123 before the feeding operation commences so as to contract the plunger 123*a*, whereby the shutter plate 91 moves to the opening position and is maintained at the opening position by the keep solenoid 123.

In the feeding device U2 according to the sixth exemplary embodiment having the above-described configuration, the keep solenoid 123 is actuated in accordance with the size of the recording paper S prior to the feeding operation so as to move the shutter plate 91 to the closing position or the opening position, thereby opening or closing the outer suction ports 31*b*. Then, after the outer suction ports 31*b* are opened or closed, the recording paper S is attracted to the suction head 22 by suction and is transported downstream. Therefore, as in the first to fifth exemplary embodiments, in the case where the small-size recording paper S1 is used, the outer suction ports 31*b* are closed so that the recording paper S1 is attracted to the suction head 22 by suction mostly through the inner suction ports 31*a*.

Seventh Exemplary Embodiment

Although the following description relates to a feed tray according to a seventh exemplary embodiment of the present invention, components in the seventh exemplary embodiment that correspond to those in the first to sixth exemplary embodiments are given the same reference numerals, and detailed descriptions thereof will be omitted. The seventh exemplary embodiment differs from the first to sixth exemplary embodiments with respect to the following points, but is the same as the first to sixth exemplary embodiments with respect to other points.

Figure 23:
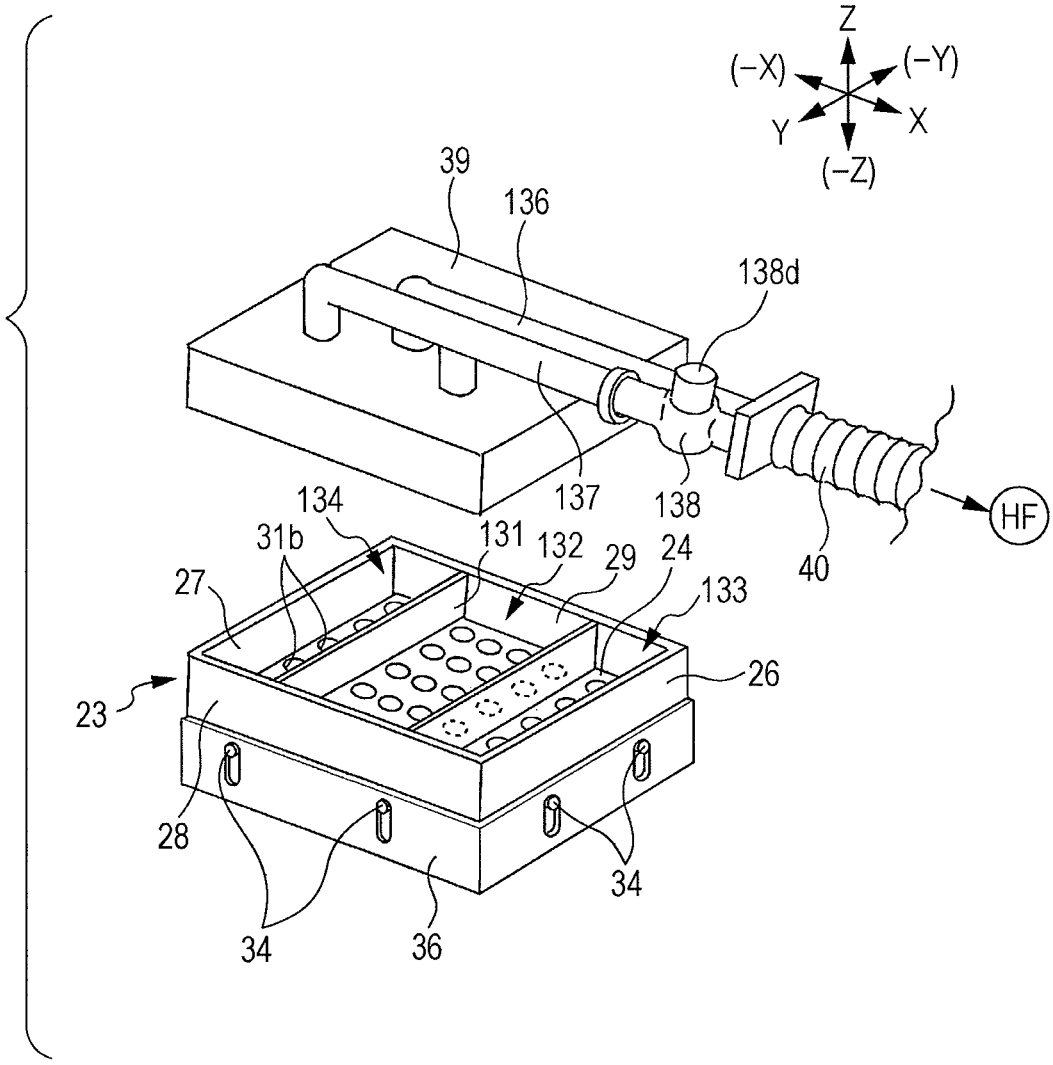
FIG. 23 illustrates a relevant part of a blocking unit according to a seventh exemplary embodiment.

FIG. 23 illustrates a relevant part of a blocking unit according to the seventh exemplary embodiment.

Figure 24A:
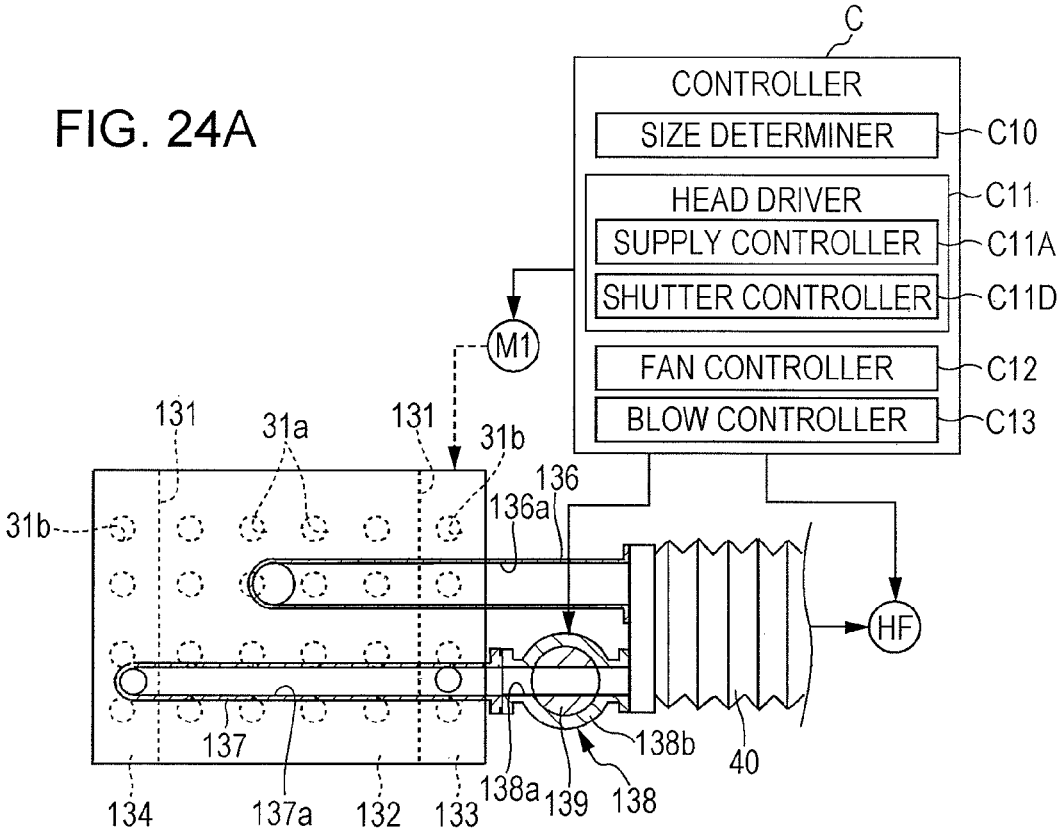
FIGS. 24A to 24C illustrate gas flow paths in the seventh exemplary embodiment, FIG. 24A being a cross-sectional view of a relevant part, FIG. 24B illustrating a state where a valve is open, FIG. 24C illustrating a state where the valve is closed.
Figure 24B:
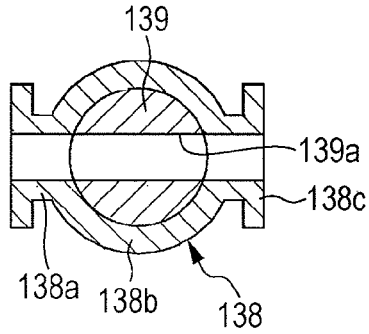
Figure 24C:
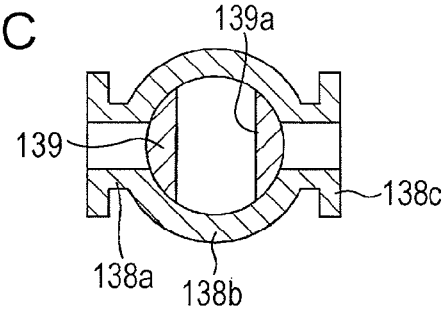

FIGS. 24A to 24C illustrate gas flow paths in the seventh exemplary embodiment. Specifically, FIG. 24A is a cross-sectional view of a relevant part, FIG. 24B illustrates a state where a valve is open, and FIG. 24C illustrates a state where the valve is closed.

A feeding device U2 according to the seventh exemplary embodiment differs from that in the first exemplary embodiment in not being provided with the detachable shutter plates 62 and the corresponding configuration, and the exhaust duct 39*f* is also omitted therefrom.

Referring to FIGS. 23 and 24A to 24C, in the head body 23 according to the seventh exemplary embodiment, front and rear support walls 131 are disposed on the upper surface of the base plate 24 so as to separate the inner suction ports 31*a* and the outer suction ports 31*b* from each other. The support walls 131 extend in the left-right direction from the left sidewall 28 to the right sidewall 29 and function as bulkheads as an example of partition members.

Therefore, a space surrounded by the pair of front and rear support walls 131, the left and right sidewalls 28 and 29, the base plate 24, and the upper plate 39*a* of the cover 39 forms an inner exhaust chamber 132. Furthermore, a space surrounded by the front sidewall 26, the front support wall 131, the left and right sidewalls 28 and 29, the base plate 24, and the upper plate 39*a* forms a front exhaust chamber 133. Moreover, a space surrounded by the rear sidewall 27, the rear support wall 131, the left and right sidewalls 28 and 29, the base plate 24, and the upper plate 39*a* forms a rear exhaust chamber 134. The front exhaust chamber 133 and the rear exhaust chamber 134 constitute an outer exhaust chamber according to the seventh exemplary embodiment.

The cover 39 supports an inner exhaust duct 136 extending forward and whose one end is connected to the inner exhaust chamber 132, and also supports an outer exhaust duct 137 extending forward and whose ends are connected to the outer exhaust chambers 133 and 134. An inner exhaust path 136*a* as an example of a first flow path through which gas in the inner exhaust chamber 132 is exhausted is formed inside the inner exhaust duct 136. An outer exhaust path 137*a* as an example of a second flow path through which gas in the outer exhaust chambers 133 and 134 is exhausted is formed inside the outer exhaust duct 137.

The front end of the outer exhaust duct 137 is connected to an on-off valve 138 as an example of a blocking member included in the blocking unit. The on-off valve 138 has a rear flow-path section 138*a* connected to the outer exhaust path 137*a*, a valve-body accommodating section 138*b* provided in the middle of the on-off valve 138, and a front flow-path section 138*c* connected to the bellows member 40. The valve-body accommodating section 138*b* rotatably supports a valve body 139. The valve body 139 is provided with a valve flow-path section 139*a* that passes through the interior of the valve body 139. The valve body 139 is rotatably movable between a connecting position shown in FIG. 24B and a blocking position shown in FIG. 24C by a manipulator 138*d* as an example of a drive source. Specifically, the connecting position corresponds to a connected state between the valve flow-path section 139*a* and the flow-path sections 138*a* and 138*c* within the on-off valve 138, whereas the blocking position corresponds to a blocked state between the valve flow-path section 139*a* and the flow-path sections 138*a* and 138*c*.

Referring to FIGS. 23 and 24A to 24C, the front end of the inner exhaust duct 136 and the front end of the on-off valve 138 are connected to the exhaust fan HF via the bellows member 40.

Referring to FIGS. 24A to 24C, the feed controller Cl in the seventh exemplary embodiment includes a shutter controller C11D in place of the shutter mover C11B in the fifth exemplary embodiment.

The shutter controller C11D in the seventh exemplary embodiment moves the valve body 139 to the connecting position or the blocking position on the basis of the type of recording paper S determined by the size determiner C10. If the recording paper S is of a small-size type, the shutter controller C11D in the seventh exemplary embodiment actuates the manipulator 138*d* before the feeding operation commences so as to move the valve body 139 to the blocking position shown in FIG. 24C corresponding to the closing position. If the recording paper S is of a large-size type, the shutter controller C11D actuates the manipulator 138*d* before the feeding operation commences so as to move the valve body 139 to the connecting position shown in FIG. 24B corresponding to the opening position.

In the feeding device U2 according to the seventh exemplary embodiment having the above-described configuration, the manipulator 138*d* is actuated in accordance with the size of the recording paper S prior to the feeding operation so as to move the valve body 139 to the connecting position or the blocking position, thereby setting the outer exhaust path 137*a* in a connected state or blocked state. Specifically, a switching operation for performing or not performing an exhaust process through the outer suction ports 31*b* is performed. After the valve body 139 is moved, the recording paper S is attracted to the suction head 22 by suction and is transported downstream. Therefore, in the feeding device U2 according to the seventh exemplary embodiment, in the case where the small-size recording paper S1 is used, the valve body 139 moves to the blocking position so that suction of gas through the outer suction ports 31*b* is stopped. Consequently, the recording paper S1 is attracted to the suction head 22 by suction mostly through the inner suction ports 31*a*, as in the first to sixth exemplary embodiments.

Modifications

Although the exemplary embodiments of the present invention have been described in detail above, the present invention is not to be limited to the above exemplary embodiments and permits various modifications within the scope of the invention defined in the claims. Modifications H01 to H09 of the above exemplary embodiments of the present invention will be described below.

In a first modification H01 of the above exemplary embodiments, the image forming apparatus U is not limited to a copier, and may be applied to other types of image forming apparatuses, such as a printer or a facsimile apparatus. Furthermore, the above exemplary embodiments are not limited to a color image forming apparatus, and may be applied to a monochrome image forming apparatus. Furthermore, the above exemplary embodiments are not limited to a tandem-type image forming apparatus, and may be applied to a rotary-type image forming apparatus. Moreover, the above exemplary embodiments are not limited to an electrophotographic image forming apparatus, and may be applied to other types of image forming apparatuses, such as an inkjet recording type or a thermal transfer type.

In a second modification H02, the inner skirts 36*b* provided in the above exemplary embodiments may be omitted therefrom. Because the length L1 of the small-size recording paper S1 in the transport direction is larger than the length La of the outer skirts 36*a* in the transport direction, the inner skirts 36*b* at both sides in the transport direction may be omitted. However, if the length of minimum-size recording paper S1 in the transport direction is smaller than the length of the outer skirts 36*a* in the transport direction, an inner skirt may be added to the rear side in the transport direction, that is, the left side, or inner skirts may be added to both sides.

In a third modification H03, although the front and rear side guides 13 are configured to move toward and away from each other in the above exemplary embodiments, a configuration in which, for example, one of the side guides 13 in the width direction is fixed while the other side guide 13 is movable in the width direction may be employed as an alternative. Furthermore, although the side guides 13 are supported in a slidably movable manner, a configuration in which, for example, the positions of the side guides 13 are changeable by inserting or removing the side guides 13 relative to the base plate 4, or a configuration in which the side guides 13 are normally set at retreated positions but are movable to usage positions from the retreated positions under a certain condition (in this case, when the recording paper S is of a small-size type) is also possible. This similarly applies to the end guide 12.

The above exemplary embodiments employ a configuration in which the suction ports are divided into the inner suction ports 31*a* and the outer suction ports 31*b* such that suction of gas through the outer suction ports 31*b* can be executed or discontinued. Alternatively, in a fourth modification H04, for example, one or more intermediate suction ports may be provided between the inner suction ports and the outer suction ports. In that case, a shutter similar to those in the first to seventh exemplary embodiments may be provided for the intermediate suction port or ports so that the intermediate suction port or ports may be opened or closed in accordance with the size of the recording paper S.

The specific shape of the shutter and the configuration for actuating the shutter in the above exemplary embodiments are not limited to those mentioned in the above exemplary embodiments and may be changed where appropriate. For example, in a fifth modification H05, the shape of the cam section 84 may be changed to an eccentric cam shape, the rotatable range thereof may be changed, the cam section 84 may be rotated automatically by a motor, the keep solenoid 123 and the on-off valve 138 may be replaced with known types of components other than those mentioned in the above exemplary embodiments, or the shutter moving mechanism may be constituted of a combination of a motor, a rack gear, and a pinion gear. Furthermore, although the controller C automatically actuates the keep solenoid 123 or the on-off valve 138 in accordance with the type of medium used, a configuration in which the shutter plate 91 or the valve body 139 is moved manually, as in the third exemplary embodiment, is also possible.

The seal skirt 36 as an example of a peripheral member in the above exemplary embodiments is not limited to a plate-shaped component mentioned in the above exemplary embodiments and may be changed where appropriate. For example, in a sixth modification H06, the seal skirt 36 may be in the form of a strip curtain with multiple strips hanging downward so that the seal skirt 36 may extend in conformity to the recording paper S that may bend when separating the uppermost sheet of recording paper S from the remaining sheets. As other examples of the sixth modification H06, the seal skirt 36 may be formed of an elastic component that elastically deforms when such bending occurs, or may be in the form of a curtain.

In a seventh modification H07, although the descriptions of the above exemplary embodiments are directed to a case where the length of a minimum-size medium in the width direction is smaller than the length of the seal skirt 36 in the width direction, the above exemplary embodiments may also be applied to a case where the length of the medium in the width direction is smaller than the length of the seal skirt 36 in the transport direction. Specifically, in the first to seventh exemplary embodiments, the components disposed at both sides in the width direction, that is, at the front and rear sides, may alternatively be disposed at one side or both sides in the transport direction, that is, at the left side or both the left and right sides. Furthermore, if the lengths of the minimum-size medium both in the width direction and the transport direction are smaller than those of the seal skirt 36, the shutters and the like according to the first to seventh exemplary embodiments may be disposed for both the width direction and the transport direction.

In an eighth modification H08, although the recording paper S is used as an example of a medium in the above exemplary embodiments, the above exemplary embodiments may also be applied to an alternative configuration that feeds a thin-film-like medium, such as an OHP sheet.

In a ninth modification H09, although the shutter is positioned to close the suction surface of the suction head in the above exemplary embodiments, the above exemplary embodiments may also be applied to a configuration in which the shutter is disposed so as to block a flow path extending to an area to be closed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium feeding device comprising:

a loading member on which a medium is loaded;

a holding member that includes:

gas suction openings facing the medium that is loaded on the loading member, and a suction unit that is connected to the gas suction openings and performs suction of gas, the holding member being configured to attract the medium while suction is performed;

a blocking unit that blocks the suction of gas through at least one of the gas suction openings corresponding to a position at an outer side of the medium when the medium is attracted to the holding member by suction;

a first flow path that connects the suction and the gas suction opening that corresponds to a position at an inner side of the medium; and a second flow path that connects the suction unit and the gas suction opening that corresponds to a position at the outer side of the medium, wherein the blocking unit includes a blocking member that loses the second flow path when the medium is attracted to the holding member by suction.

2. The medium feeding device according to claim 1, wherein the blocking unit includes a closing member that closes the gas suction openings, and wherein the blocking unit blocks the suction of gas by closing at least one of the gas suction openings disposed outside the edge of the medium by the closing member.

3. The medium feeding device according to claim 1, wherein the blocking unit blocks the suction of gas through at least one of the gas suction openings disposed outside an edge of the medium when the medium is attracted to the holding member by suction.

4. The medium feeding device according to claim 1, wherein the blocking unit blocks the suction of gas through the at least one of the gas suction openings without blocking suction of gas through all of gas suction openings.

5. The medium feeding device according to claim 1, wherein the blocking unit blocks the suction of gas through at least one of the gas suction openings disposed at an outer periphery of the holding member without blocking suction of gas through at least one of the gas suction openings disposed at an inner portion the holding member.

6. The medium feeding device according to claim 1, wherein the blocking unit only partially blocks suction of gas through one of the gas suction openings corresponding to a position at the outer side of the medium when the medium is attracted to the holding member by suction.

7. The medium feeding device according to claim 1, wherein the blocking unit only partially blocks suction of gas through one of the gas suction openings, which are disposed in a direction perpendicular to a medium transporting direction corresponding to a position at the outer side of the medium when the medium is attracted to the holding member by suction.

8. A medium feeding device comprising:

a loading member on which a medium is loaded;

a holding member that includes:

gas suction openings facing the medium that is loaded on the loading member, and a suction unit that is connected to the gas suction openings and performs suction of gas, a peripheral member extending toward the loading member from the holding member and disposed so as to surround the gas suction openings, the holding member being configured to attract the medium to one end of the peripheral member facing the loading member while suction is performed;

a blocking unit that blocks the suction of gas through at least one of the gas suction openings disposed inside an edge of the peripheral member and outside an edge of the medium;

a first flow path that connects the suction unit and the gas suction opening disposed inside the edge of the medium; and a second flow path that connects the suction unit and the gas suction opening disposed inside the edge of the peripheral member and outside the edge of the medium, wherein the blocking unit includes a blocking member that closes the second flow path when the medium is attracted to the holding member by suction.

9. The medium feeding device according to claim 8, wherein the blocking unit includes a closing member that closes the gas suction openings, and wherein the blocking unit blocks the suction of gas by closing at least one of the gas suction openings disposed inside the edge of the peripheral member and outside the edge of the medium.

10. The medium feeding device according to claim 8, wherein the peripheral member includes an inner peripheral member that partitions an area surrounded by the peripheral member between an area inside an edge of a minimum-size medium that can be accommodated in a container and another area, and wherein the blocking unit blocks the suction of gas through the gas suction opening disposed between the peripheral member and the inner peripheral member.

11. A medium feeding device comprising:

a container that accommodates a medium;

a loading member that is supported within the container and that loads the medium on a surface thereof;

a holding member having a holding member body disposed facing the loading member, gas suction openings formed in the holding member body, a peripheral member extending toward the loading member from the holding member body and disposed so as to surround the gas suction openings, a chamber formed within the peripheral member and surrounded by the peripheral member, and a suction unit that is connected to the gas suction openings and that performs gas suction, wherein the holding member holds the medium by attracting the medium by suction to one end of the peripheral member facing the loading member as the suction unit performs the suction, and wherein the gas suction openings include a gas suction opening disposed inside an edge of the peripheral member and outside an edge of the medium;

a blocking unit that blocks the suction of gas through the gas suction opening disposed inside the edge of the peripheral member and outside the edge of the medium;

a first flow path that connects the suction unit and the gas suction opening disposed inside the edge of the medium whose length is smaller than the length of the peripheral member; and a second flow path that connects the suction unit and the gas suction opening disposed outside the edge of the medium whose length is smaller than the length of the peripheral member, wherein the blocking unit includes a blocking member that closes the second flow path in response to a size determiner determining that the length of the medium is smaller than the length of the peripheral member.

12. The medium feeding device according to claim 11, wherein the blocking unit includes an opening-and-closing member that opens and closes the gas suction openings, and wherein the blocking unit blocks the suction of gas by closing the gas suction opening disposed outside the edge of the medium.

13. The medium feeding device according to claim 12, wherein the blocking unit includes a blocking member that is supported by the holding member body in a movable manner between an opening position for opening the gas suction openings and a closing position for closing the gas suction opening disposed outside the edge of the medium if the length of the medium is smaller than the length of the peripheral member, wherein the blocking member moves to the closing position to close the gas suction opening disposed outside the edge of the medium so as to block the suction of gas when the medium is attracted to the holding member by suction.

14. The medium feeding device according to claim 13, further comprising an edge alignment member supported within the container and having a contact surface that is contactable with the edge of the medium loaded on the loading member so as to align the edge of the medium, wherein the blocking member includes a blocking member body supported in a movable manner between the opening position and the closing position, an engagement section supported by the blocking member body, and a biasing member that biases the blocking member body toward the opening position, and wherein the medium feeding device further comprises an engaging section disposed at a position corresponding to the engagement section and supported by the edge alignment member, wherein when the engaging section comes into contact with the engagement section, the engaging section moves the blocking member body from the opening position to the closing position, wherein the engaging section is contactable with the engagement section if the length of the medium is smaller than the length of the peripheral member and the contact surface of the edge alignment member is in contact with the edge of the medium, and wherein the engaging section is positioned away from the engagement section if the length of the medium is larger than or equal to the length of the peripheral member.

15. The medium feeding device according to claim 11, further comprising an edge alignment member supported within the container and having a contact surface that is contactable with the edge of the medium loaded on the loading member so as to align the edge of the medium, wherein when the medium is to be fed, the loading member moves to a first position close to the holding member so as to bring the medium close to the peripheral member, and wherein the blocking unit includes a blocking member that is supported by the edge alignment member in a movable manner toward and away from the holding member and that is disposed at a position corresponding to the gas suction opening disposed outside the edge of the medium in a case where the contact surface of the edge alignment member is in contact with the medium whose length is smaller than the length of the peripheral member, wherein the blocking member is apart from the loading member if the length of the medium is larger than or equal to the length of the peripheral member, and wherein if the length of the medium is smaller than the length of the peripheral member and the contact surface of the edge alignment member is in contact with the edge of the medium, the blocking member engages with the loading member and moves in conjunction with the movement of the loading member toward the first position so as to close the gas suction opening disposed outside the edge of the medium and block the suction of gas.

16. The medium feeding device according to claim 11, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

17. The medium feeding device according to claim 12, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

18. The medium feeding device according to claim 13, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

19. The medium feeding device according to claim 14, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

20. The medium feeding device according to claim 15, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

21. The medium feeding device according claim 11, wherein the peripheral member includes a first peripheral member disposed outside an edge of a minimum-size medium that can be accommodated in the container, and a second peripheral member disposed inside the edge of the minimum-size medium, and wherein the blocking unit blocks the suction of gas through the gas suction opening disposed between the first peripheral member and the second peripheral member.

22. An image forming apparatus comprising the medium feeding device according to claim 11.

* * * * *